US007238457B2

(12) United States Patent
Shibata et al.

(10) Patent No.: US 7,238,457 B2
(45) Date of Patent: Jul. 3, 2007

(54) ELECTROPHOTOGRAPHIC PHOTORECEPTOR

(75) Inventors: Toyoko Shibata, Zama (JP); Masao Asano, Tokyo (JP); Hiroshi Yamazaki, Hachioji (JP); Tomoko Sakimura, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 183 days.

(21) Appl. No.: 11/040,448

(22) Filed: Jan. 21, 2005

(65) Prior Publication Data

US 2005/0164105 A1 Jul. 28, 2005

(30) Foreign Application Priority Data

Jan. 27, 2004 (JP) ..... 2004-018036

(51) Int. Cl.
*G03G 15/02* (2006.01)

(52) U.S. Cl. ..... 430/58.05; 430/58.85; 430/56; 430/60

(58) Field of Classification Search ..... 430/58.05, 430/58.85, 56, 60
See application file for complete search history.

(56) References Cited

FOREIGN PATENT DOCUMENTS

| | | |
|---|---|---|
| JP | 63-65449 | 3/1988 |
| JP | 3-149560 | 6/1991 |
| JP | 5-25102 | 2/1993 |
| JP | 10-310635 | 11/1998 |
| JP | 11-327188 | 11/1999 |
| JP | 2001-255685 | 9/2001 |

OTHER PUBLICATIONS

* English Abstract for Japanese Patent No. 63-65449 dated Mar. 24, 1988.
** English Abstract for Japanese Patent No. 3-149560 dated Jun. 26, 1991.
*** English Abstract for Japanese Patent No. 5-25102 dated Feb. 2, 1993.
**** English Abstract for Japanese Patent No. 10-310635 dated Nov. 24, 1998.
***** English Abstract for Japanese Patent No. 11-327188 dated Nov. 26, 1999.
****** English Abstract for Japanese Patent No. 2001-255685 dated Sep. 21, 2001.

*Primary Examiner*—Mark A. Chapman
(74) *Attorney, Agent, or Firm*—Cantor Colburn LLP

(57) ABSTRACT

An electrophotographic photoreceptor comprising a support, an interlayer containing inorganic particle and a photosensitive layer is disclosed. The photosensitive layer contains a mixture of compounds represented by Formula (1) having different n and (Rp+Rs) is not more than 99%, wherein Rp is a ratio of a component having the maximum content in the mixture and Rs is a ratio of a component having the content next to the maximum content in percent.

$$X\text{—}(\text{CTM-group})_n\text{—}Y \quad (1)$$

In the formula, CTM-group is a charge transfer group; X and Y are each a hydrogen atom, a halogen atom or a monovalent organic group; and n is an integer of from 0 to 10, provided that n is an integer of from 1 to 10 when both X and Y are hydrogen atom or a halogen atom. A processing cartridge comprising the electrophotographic photoreceptor is also disclosed.

17 Claims, 1 Drawing Sheet

ELECTROPHOTOGRAPHIC PHOTORECEPTOR

FIELD OF THE INVENTION

The present invention relates to an electrophotographic photoreceptor, a processing cartridge, an image forming apparatus and an image forming method to be used for image formation by the electrophotographic process, further in detail, relates to the electrophotographic photoreceptor, processing cartridge, image forming apparatus and image forming method to be used for image formation by the electrophotographic process commonly used in the field of copying machine and printer.

RELATED ART

Recently, organic photoreceptor has become the principal type of electrophotographic photoreceptors in place of an inorganic photoreceptor. The reason being that organic photoreceptor has a wider selection range of a photosensitive material, superiority in environmental suitability and lower cost compared with an inorganic photoreceptor such as a selenium photoreceptor and an amorphous silicon photoreceptor.

Besides, digital image forming system using a LED or a laser as the light source is rapidly permeating in the field of a printer for personal computer and usual copying machine for reason of ease of image processing and development of a combined machine function. In addition, technique has been developed to progress the precision of the image and to form a high quality electrophotographic image. For example, technique is disclosed in which imagewise exposure is carried out by a laser beam having small spotting area for raising the dot density to form a high precision latent image, and the latent image is developed by a fine particle toner, c.f. Publication 1.

An organic photoreceptor is required for forming such the high quality image, which has high sensitivity and stable properties concerning the thermal environment.

Hitherto, for satisfying such the requirements of organic photoreceptor, the organic photoreceptor are constituted of a photosensitive layer in which the functions are separated by a charge generation layer and a charge transfer layer, and the charge transfer layer contains a large amount of a lower molecular weight charge transfer material having a molecular weight of approximately 500. However, in the charge transfer layer having such a constitution, the quality of the layer is easily degraded and the surface of the charge transfer layer is also easily contaminated by foreign matter. The surface of the photoreceptor tends to be contaminated by paper powder or toner components during the developing process, transferring unit and cleaning unit arranged around the photoreceptor. As a result of that, recurring image defects such as a speckle (stain in a strawberry shape) and black spotting tends to occur. Satisfactory sensitivity is difficult to obtain in a high speed copying machine in which the duration between the exposing process and the developing process is very short or under a low temperature and/or low humidity condition. As a result of that, dot image cannot be exactly reproduced and a fine line image tends to be easily degraded.

As a measure for solving such the problem, a method using a charge transfer material having high molecular weight is developed. For example, an organic photoreceptor has been reported in Publication 2, in which a charge transfer material having a bi-styryl structure with a molecular weight of 1,000 or more is used. Such a compound, however, cannot be uniformly dispersed in the binder resin when the compound is contained in the charge transfer layer since the compatibility of the compound with the binder resin tends to be insufficient. Consequently, the sensitivity becomes insufficient and damage such as cracking of the charge transfer layer tends to occur. Furthermore, a photoreceptor using a charge transfer material having a molecular weight of from 3,000 to 5,000 is reported in Publications 3 and 4. However, the residual potential tends to be raised on the photoreceptor using such the compound since the terminal of the compound is not blocked and the problem of the compatibility with the binder resin has not been sufficiently dissolved.

A photoreceptor is proposed in Publication 5, wherein titanium oxide pigment is incorporated in an inter layer provided on an electro-conductive layer so as to restrain an image deficiency such as speckles which is apt to be generated when the above mentioned low molecular weight CGM is employed. However, characteristics of the surface of the photoreceptor being contaminated, and generation of speckle are not improved, though deficiency of generation of black spotting or increasing residential potential is improved.

A photoreceptor is proposed in Publication 5, in the surface layer of which fluoro-resin particles are contained for preventing the contamination of the surface. However the use of the fluoro-resin particles in the surface layer tends to cause the image spreading. The mechanical strength of the surface layer also tends to be degraded and the surface of the photoreceptor is easily worn by the friction of the cleaning unit. Accordingly, a satisfactory image cannot be constantly provided.

Publication 1: Japanese Patent Publication Open to Public Inspection hereinafter referred to as JP O.P.I. Publication, No. 2001-255685.

Publication 2: JP O.P.I. Publication No. 3-149560

Publication 3: JP O.P.I. Publication No. 10-310635

Publication 4: JP O.P.I. Publication No. 5-25102

Publication 5: JP O.P.I. Publication No. 63-65449

Publication 6: JP O.P.I. Publication No. 11-327188

SUMMARY OF THE INVENTION

An embodiment of the present invention is an electrophotographic photoreceptor containing a support, an inter layer having organic particles and a photosensitive layer provided on the support, wherein the photosensitive layer contains a mixture of two or more compounds each of which is represented by Formula (1) having a specific number n different each other, $$X—(\text{CTM-group})_n—Y \quad (1)$$

wherein CTM-group is a charge transfer group; X and Y are each a hydrogen atom, a halogen atom or a mono-valent organic group; and n is an integer of 0 to 10, provided that n is not 0 when both X and Y are a hydrogen atom or a halogen atom, and (Rp+Rs) is not more than 99%, wherein Rp is a content of a compound represented by Formula (1) which has a first specific number n and a maximum content in the mixture, and Rs is a content of a component represented by Formula (1) which has a second specific number n and a content next to the maximum content based on weight in percent.

DETAILED DESCRIPTION OF THE INVENTION

Figure 1:
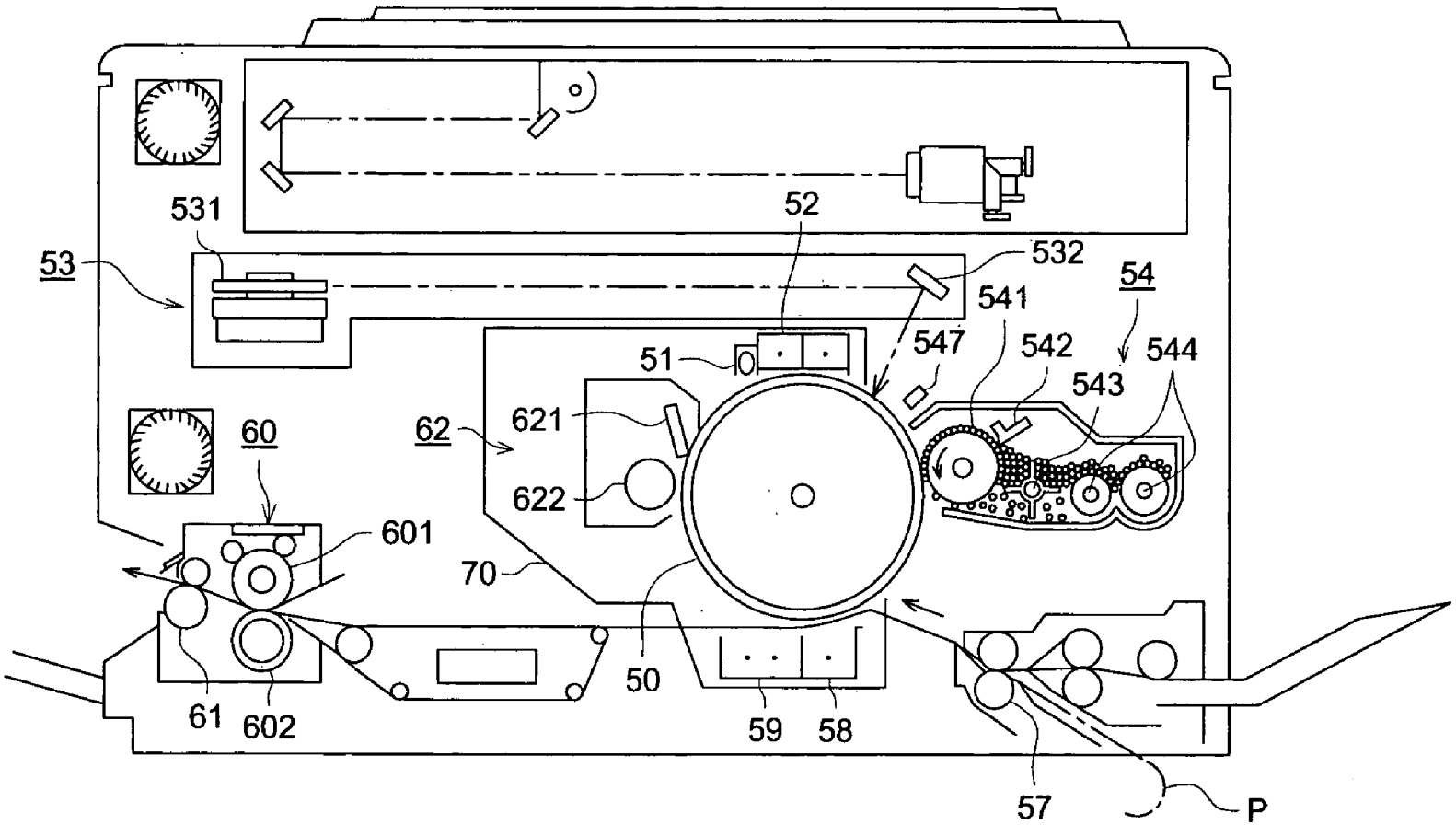
FIG. 1 shows the cross section of the constitution of an image forming apparatus as an example of the image forming method according to the invention.

The present invention will be described in detail below. Embodiments of an electrophotographic photoreceptor, and a processing cartridge, an image forming method and an image forming apparatus each using the photoreceptor of the invention can prevent the defects of the image caused by the decrease of the sensitivity, which tends to occur in the course of high speed copying or copying under a low temperature and low humidity condition, by the lowering of the sharpness of the image accompanying the decreasing of image density and thinning of character image caused by the charge fluctuation of the solid black image area. Further, the embodiments can prevent recurring image defects such as the speckle and the black spotting caused by the contamination on the photoreceptor surface and the damage such as cracking of the photoreceptor surface and can obtain a clear electrophotographic image of high optical density and high resolution continuously.

As a result of the detailed investigation by the inventors on the binder resin and the charge transfer material constituting the charge transfer layer, it was discovered that as the compatibility of the charge transfer material with the binder resin is raised, the high speed response of the sensitivity under low temperature and low humidity is improved, the contamination of the surface of the photoreceptor is inhibited to prevent the occurrence of the recurring image defects such as speckle and the lack of toner transfer, damage such as the cracking, and a clear image of high density and high resolution can be stably obtained when a mixture of compounds each having different molecular weight from each other is used as the charge transfer material.

The image defects caused by insufficiency of high speed response of photosensitivity which tends to occur in image formation at high speed and under a low temperature and low humidity conditions and various other kinds of defects which tend to occur under high temperature and high humidity condition are prevented to provide an electrophotographic image with high image density and high sharpness by the use of the electrophotographic photoreceptor, processing cartridge, image forming method and image forming apparatus of this invention.

The electrophotographic photoreceptor of the invention contains a mixture of compounds represented by Formula (1) in which n has a range of distribution and (Rp+Rs) is not more than 99% when Rp represents the ratio of a component having the maximum content in the mixture and Rs represents the ratio of a component having the content next to the maximum content.

$$X\text{—}(\text{CTM-group})_n\text{—}Y \qquad \text{Formula (1)}$$

In Formula (1), the CTM-group is a charge transfer group; X and Y are each a hydrogen atom, a halogen atom or a mono-valent organic group; and n is an integer of from 0 to 10, provided that n is an integer of from 1 to 10 when both of X and Y are hydrogen atom or a halogen atom. In such a case, it may be that either X or Y is a hydrogen atom and the other is a halogen atom.

The electrophotographic photoreceptor of the invention comprises an electroconductive substrate having thereon a charge generation layer and a charge transfer layer containing a charge transfer material in which the charge transfer material is a mixture of compounds represented by Formula (1) in which n has a range of distribution and (Rp+Rs) is not more than 99% when Rp represents the ratio of a component having the maximum content in the mixture and Rs represents the ratio of a component having the content next to the maximum content.

"The mixture of compounds represented by Formula (1) in which n has a range of distribution and (Rp+Rs) is not more than 99% when Rp represents the ratio of a component having the maximum content in the mixture and Rs represents the ratio of a component having the content next to the maximum content" means that in the mixture of compounds, compounds each of which is represented by Formula (1) and the number of the chain structure of the CTM-group or the charge transfer group differ from each other, are in a mixed state, and the sum of Rp and Rs is not more than 99% where Rp is the content of the compound having the largest presence ratio and Rs is the content of the compound having the secondary presence ratio. Therefore, the mixture of compounds contains at least three kinds of the compounds each represented by Formula (1). By the use of such a mixture of compounds, the charge transferring ability is considerably improved; the problems of lowered sensitivity caused by processing at high speed or under conditions of low temperature and low humidity can be resolved; the permeability of the solvent or the binder resin is remarkably improved; the occurrence of the speckle and the recurring image defects such as lack of toner transfer are prevented; and in addition the damage such as cracking can be inhibited; so that the electrophotographic photoreceptor capable of forming a consistently clear electrophotographic image of high image density and high resolution can be realized.

The CTM-group in Formula (1) is a group having drift mobility of electrons or positive holes. In other word, the CTM-group is a group from which electric current caused the charge transfer can be detected by the Time-Of-Flight method.

When the CTM-group cannot exist solely itself, the CTM-group may be included within the definition of the CTM-group if a compound of the CTM-group having a hydrogen atom at the both ends thereof, and represented by H(CTM-group)H has charge transferring ability.

The mixture of compounds is represented by the following Formulas (A), (B) and (C), such the mixture of compounds can be prepared by the later-mentioned synthesizing examples.

Formulas (A)

CTM-group:

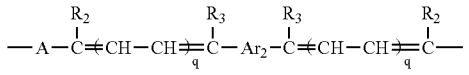

X:

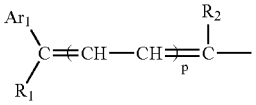

Y:

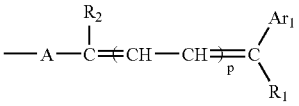

$Ar_1$ is a substituted or unsubstituted mono-valent aromatic group; $Ar_2$ is a substituted or unsubstituted di-valent aromatic group, a substituted or unsubstituted di-valent furan or thiophene group; or a group represented by Formula (2); $R_1$ through $R_3$ are each a hydrogen atom, a substituted or unsubstituted alkyl group or a substituted or unsubstituted mono-valent aromatic group; A is a di-valent group having a triarylamino group or a group represented by Formula (3), plural $Ar_1$, $R_1$, $R_2$ and $R_3$ may be the same or different from each other, and p and q are each an integer of 0 or 1.

Formula (2)

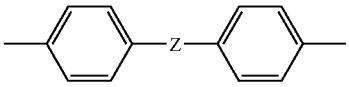

In the above, Y is a single bond, an oxygen atom, a sulfur atom, a —CH═CH— group or a —C($R_4$) ($R_5$)— group, and $R_4$ and $R_5$ may be bonded with together.

Formula (3)

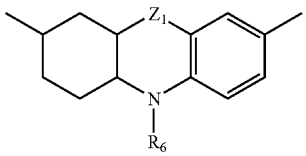

In the above, $Z_1$ is a single bond, an alkylene group, an oxygen atom or a sulfur atom; and $R_6$ is a substituted or unsubstituted alkyl group, or substituted or unsubstituted aromatic group.

Formulas (B)

CTM-group:

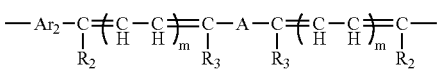

X:

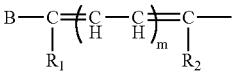

Y:

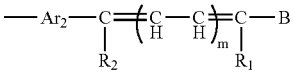

$Ar_2$ is a substituted or unsubstituted di-valent aromatic group, a substituted or unsubstituted di-valent furan or thiophene group or a group represented by Formula (2); $R_1$ through $R_3$ are each a hydrogen atom, a substituted or unsubstituted alkyl group or a substituted or unsubstituted mono-valent aromatic group; A is a divalent group having a triarylamino group or a group represented by Formula (3); and B is a substituted or unsubstituted mono-valent aromatic group; plural B, $R_1$, $R_2$ and $R_3$ each may be the same as or different from each other and m is an integer of 0 or 1.

In formulas (A) and (B), the di-valent group having a triarylamino group is a group having two bonding hands as a whole in which three bonding hands of the nitrogen atom each bonds with an aromatic ring.

In Formulas (A) and (B), as the substituted or unsubstituted mono-valent group represented by $Ar_1$ or B, a substituted or unsubstituted phenyl group and a substituted or unsubstituted naphthyl group are preferable; as the substituted or unsubstituted two-valent group represented by $Ar_1$, a substituted or unsubstituted phenylene group and a substituted or unsubstituted naphthylene group are preferable; and the substituent of these groups is preferably an alkyl group having from 1 to 4 carbon atoms, an alkoxyl group, a phenyl group and a halogen atom. As the substituted or unsubstituted di-valent group represented by $Ar_2$, a phenylene group, a naphthylene group and a biphenylene group are preferable; and a substituent of these groups is preferably an alkyl group. A di-valent furan group and a di-valent thiophene group are also preferred.

$R_1$, $R_2$, and $R_3$ are each preferably a hydrogen atom, a halogen atom, a substituted or unsubstituted alkyl group, a substituted or unsubstituted alkoxyl group or a substituted or unsubstituted aromatic group, and are preferably a hydrogen atom, an alkyl group and an alkoxyl group each having from 1 to 4 carbon atoms, a substituted or unsubstituted phenyl group or a phenyl group having a halogen atom or an alkyl group having from 1 to 4 carbon atoms.

The di-valent group represented by A is preferably a di-valent group having a triarylamino group represented by Formula (4) or Formula (6), in addition to the group represented by Formula (3).

Formula (4)

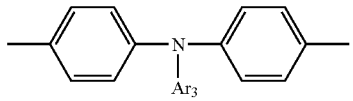

wherein $Ar_3$ is a substituted or unsubstituted mono-valent aromatic group.

Formula (6)

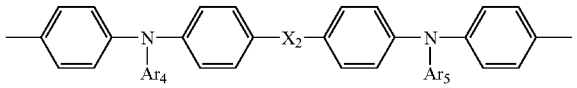

wherein $X_2$ is a single bond, a substituted or unsubstituted alkylene group, or a substituted or unsubstituted di-valent aromatic group; $Ar_4$ and $Ar_5$ are each a substituted or unsubstituted mono-valent aromatic group.

$R_6$ is a substituted or unsubstituted alkyl group or a substituted or unsubstituted aromatic group, and is preferably an alkyl group having from 1 to 4 carbon atoms or a phenyl group.

$Ar_3$ is a substituted or unsubstituted mono-valent aromatic group, and preferably an unsubstituted phenyl group or a phenyl group substituted with an alkyl group having from 1 to 4 carbon atoms or an alkoxyl group.

A preferable example of the group represented by $Ar_3$ is represented by Formula (5), Formula (5)

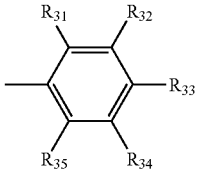

wherein $R_{31}$, $R_{32}$, $R_{33}$, $R_{34}$ and $R_{35}$ are each a hydrogen atom or an alkyl group having from 1 to 4 carbon atoms and at least one of $R_{31}$ and $R_{35}$ is an alkyl group having from 1 to 4 carbon atoms.

In the formulas (A) and (B), preferable example of the di-valent group having a triarylamino group is represented by Formula (6), Formula (6)

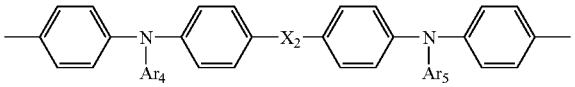

wherein $X_2$ is a single bond, a substituted or unsubstituted alkylene group, or a substituted or unsubstituted di-valent aromatic group; $Ar_4$ and $Ar_5$ are each a substituted or unsubstituted mono-valent aromatic group. Groups $Ar_4$ and $Ar_5$ are preferably an unsubstituted phenyl group or a phenyl group substituted with an alkyl group having from 1 to 4 carbon atoms or an alkoxyl group.

Typical chemical structures of the group represented by Formulas (A) and (B) are shown below. In the invention, the mixture of the compounds or mixture of compounds each represented by the following structure and different from each other in the value of n are used as the charge transfer material. The compounds in which p or q in Formula (A) or m in Formula (B) differing from each other are different compounds even if the chemical structure of them is the same. For example, one having a value of p or q as 0 and one having the value of p or q as 1 are different compounds even when each of the compounds has following structure 1A. In addition, the compounds differing in the distribution of n are different compounds even when the p or q is the same.

Specific examples of the compound represented by Formula (A).

| Chemical structure No. | A | $Ar_1$ | $R_1$ |
|---|---|---|---|
| 1A | 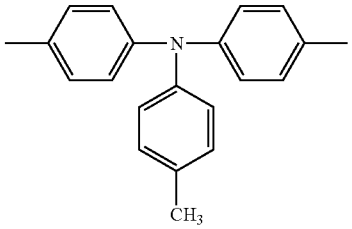 | 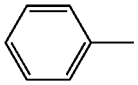 | H |
| 2A | 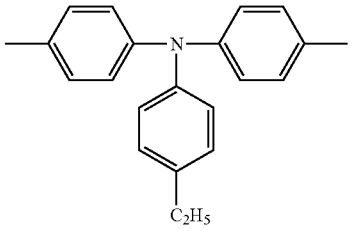 | 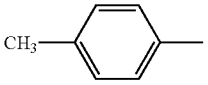 | H |
| 3A | 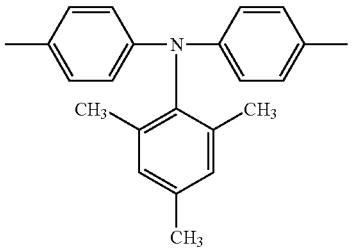 | 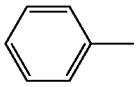 | H |
| 4A | 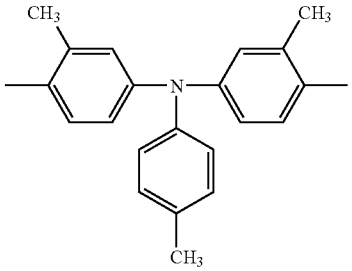 | 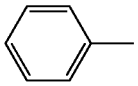 | 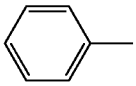 |

-continued
| | | | |
|---|---|---|---|
| 5A | 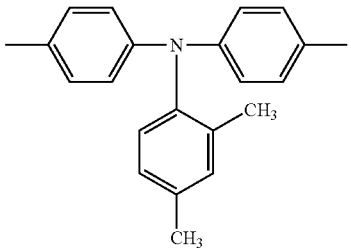 | 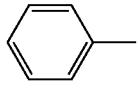 | 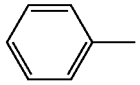 |
| 6A | 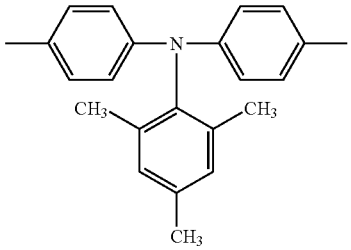 | 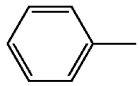 | 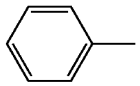 |
| 7A | 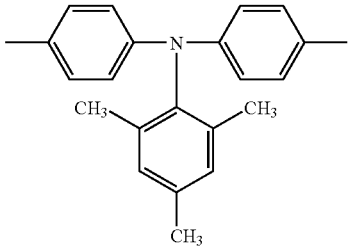 | 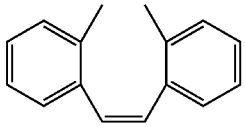 | |
| 8A | 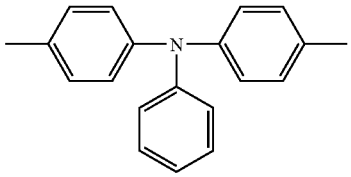 | 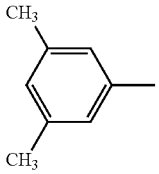 | H |
| 9A | 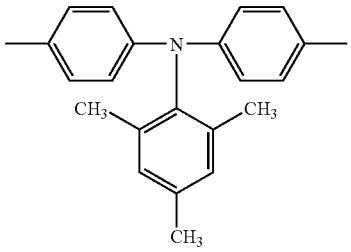 | 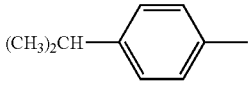 | H |
| 10A | 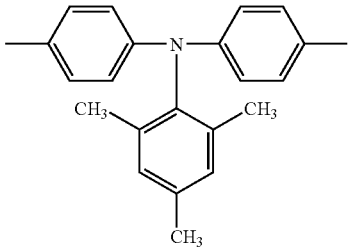 | 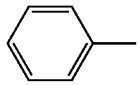 | H |

-continued
| | | | |
|---|---|---|---|
| 11A | 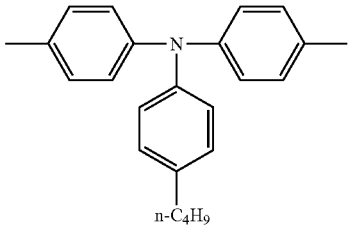 | 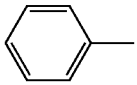 | 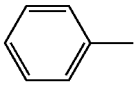 |
| 12A | 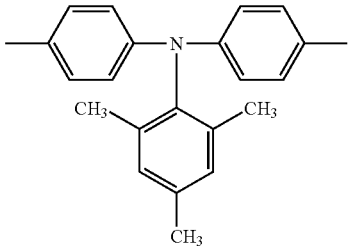 | 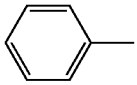 | 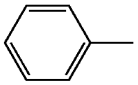 |
| 13A | 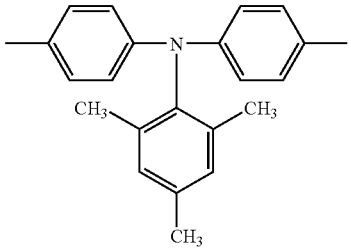 | 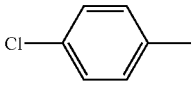 | 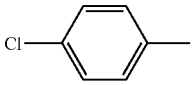 |
| 14A | 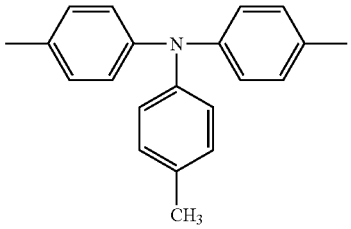 | 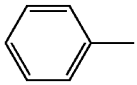 | H |
| 15A | 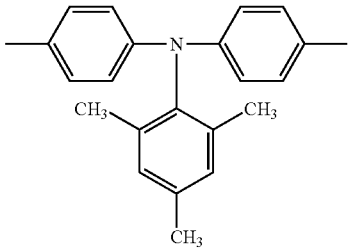 | 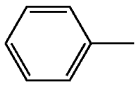 | H |
| 16A | 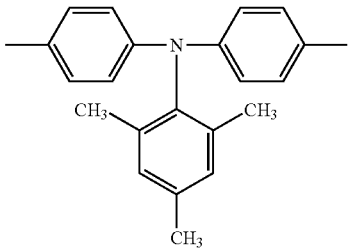 | 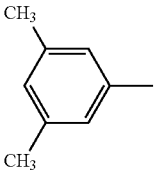 | H |

-continued
| | | | |
|---|---|---|---|
| 17A | 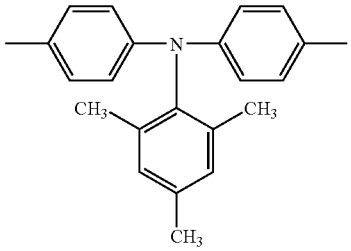 | 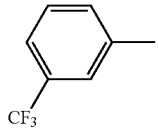 | H |
| 18A | 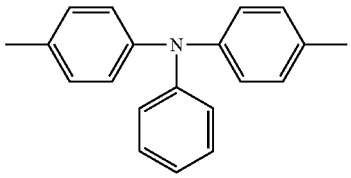 | 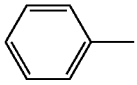 | 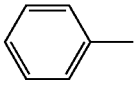 |
| 19A | 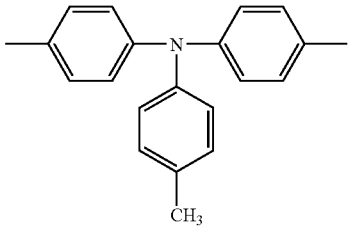 | 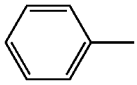 | 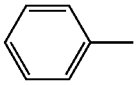 |
| 20A | 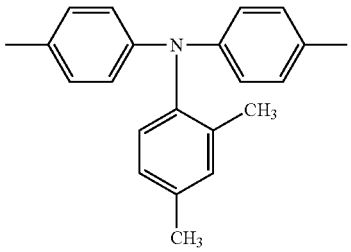 | 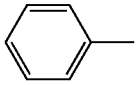 | 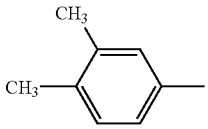 |
| 21A | 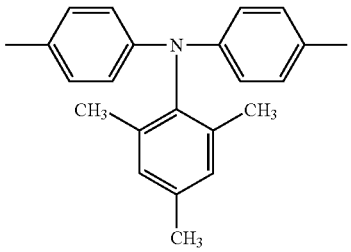 | 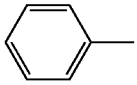 | 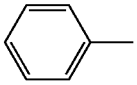 |
| 22A | 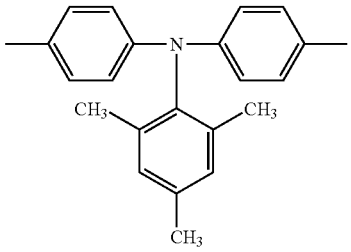 | 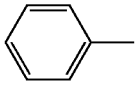 | 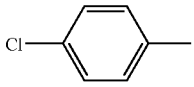 |

-continued
| | | | |
|---|---|---|---|
| 23A | 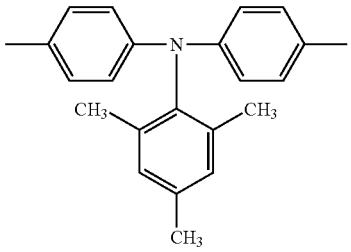 | 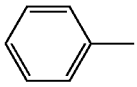 | 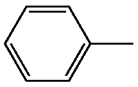 |
| 24A | 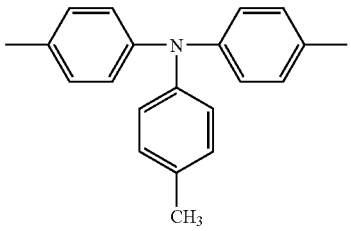 | 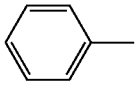 | 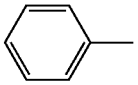 |
| 25A | 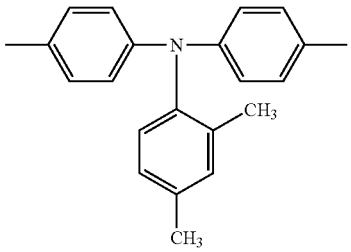 | 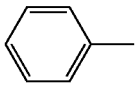 | 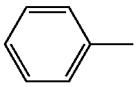 |
| 26A | 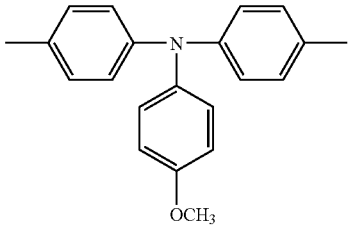 | 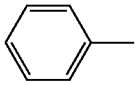 | 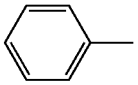 |
| 27A | 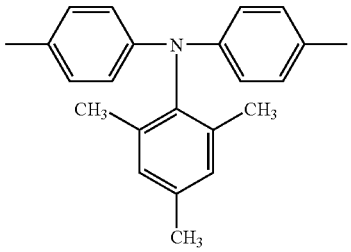 | 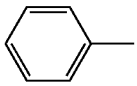 | 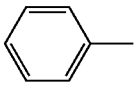 |
| 28A | 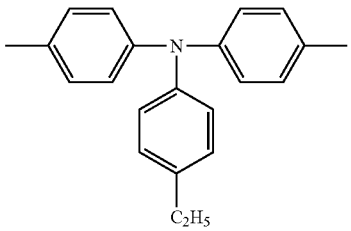 | 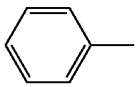 | 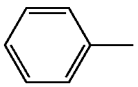 |

-continued
| | | | |
|---|---|---|---|
| 29A | 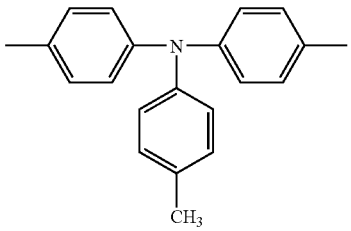 | 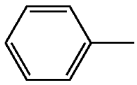 | 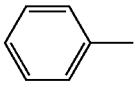 |
| 30A | 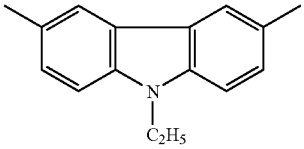 | 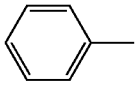 | H |
| 31A | 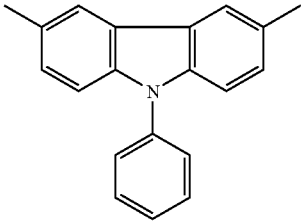 | 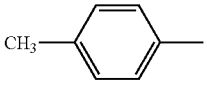 | H |
| 32A | 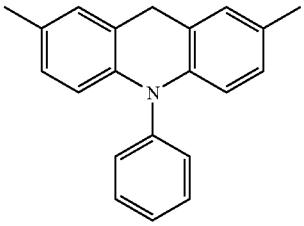 | 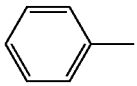 | 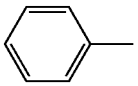 |
| 33A | 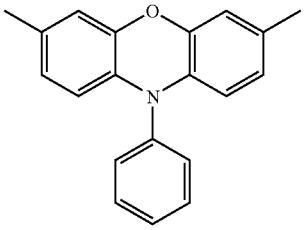 | 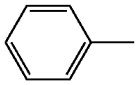 | 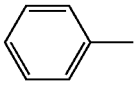 |
| 34A | 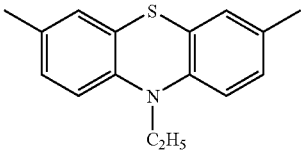 | 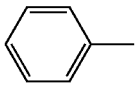 | 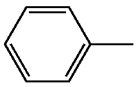 |
| 35A | 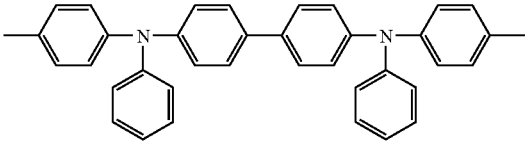 | 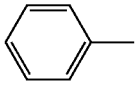 | 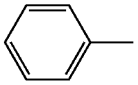 |

-continued
| | | | |
|---|---|---|---|
| 36A | 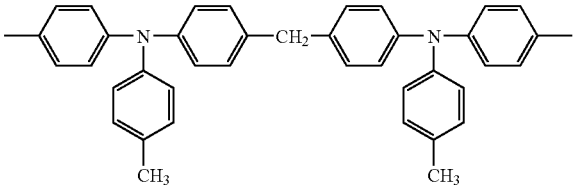 | 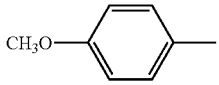 | H |
| 37A | 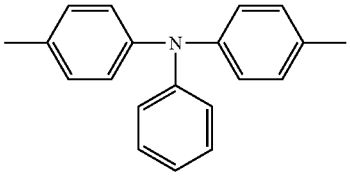 | 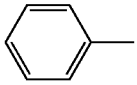 | H |
| 38A | 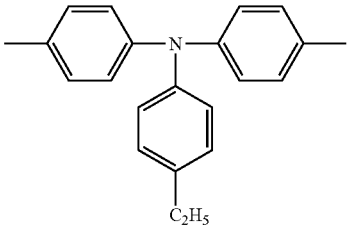 | 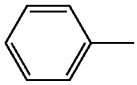 | 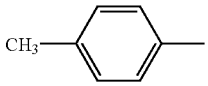 |
| 39A | 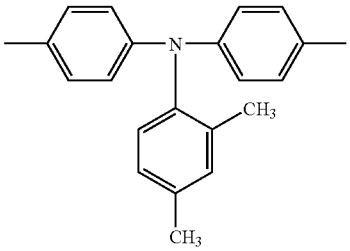 | 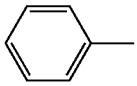 | 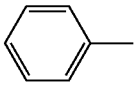 |
| 40A | 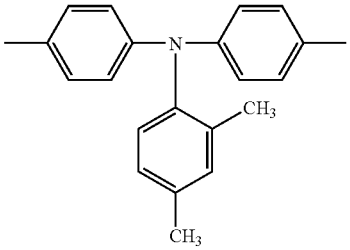 | 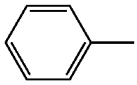 | 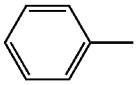 |
| 41A | 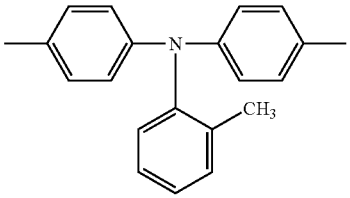 | 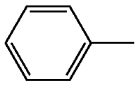 | 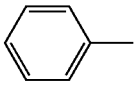 |
| 42A | 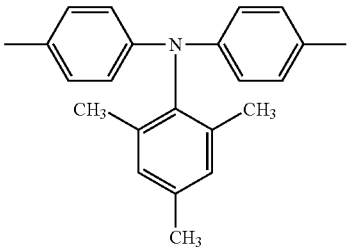 | 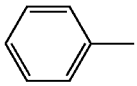 | 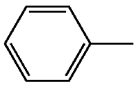 |

-continued

| Chemical structure No. | $Ar_2$ | $R_2$ | $R_3$ |
|---|---|---|---|
| 1A | | H | H |
| 2A | | H | H |
| 3A | | H | |
| 4A | | H | H |
| 5A | | H | H |
| 6A | | H | H |
| 7A | | H | H |
| 8A | | H | H |
| 9A | | H | H |
| 10A | | H | |
| 11A | | H | H |
| 12A | | H | H |

-continued
| | | | |
|---|---|---|---|
| 13A | 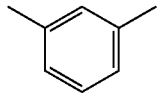 | H | H |
| 14A | 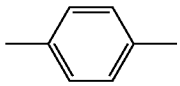 | H | H |
| 15A | 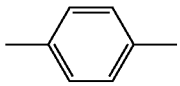 | H | H |
| 16A | 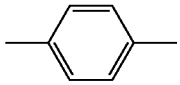 | H | H |
| 17A | 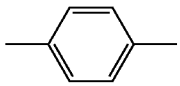 | H | H |
| 18A | 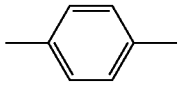 | H | H |
| 19A | 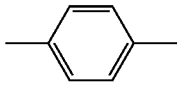 | H | H |
| 20A | 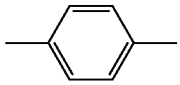 | H | H |
| 21A | 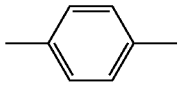 | H | H |
| 22A | 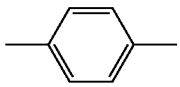 | H | H |
| 23A | 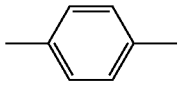 | H | 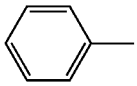 |
| 24A | 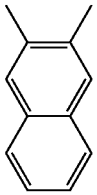 | H | H |
| 25A | 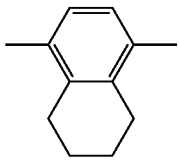 | H | H |
| 26A | 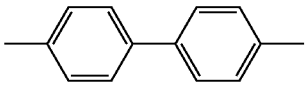 | H | H |

-continued
| | | | |
|---|---|---|---|
| 27A | 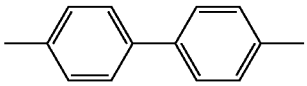 | H | 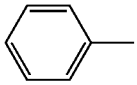 |
| 28A | 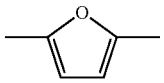 | H | H |
| 29A | 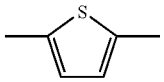 | H | H |
| 30A | 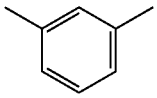 | H | H |
| 31A | 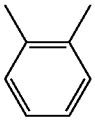 | H | H |
| 32A | 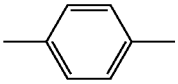 | H | H |
| 33A | 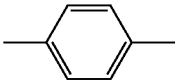 | H | H |
| 34A | 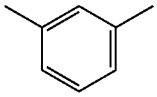 | H | H |
| 35A | 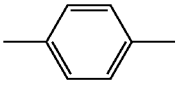 | H | H |
| 36A | 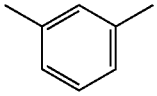 | H | H |
| 37A | 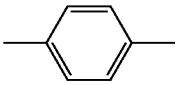 | $CH_3$— | H |
| 38A | 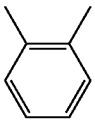 | 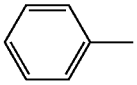 | H |
| 39A | 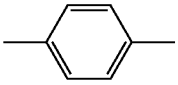 | $CH_3$— 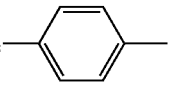 | H |
| 40A | 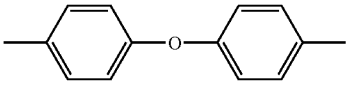 | H | H |
| 41A | 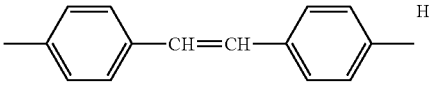 | H | H |

-continued

| | | | |
|---|---|---|---|
| 42A | 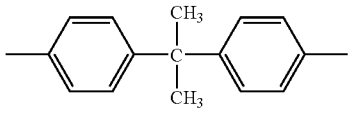 | H | H |

In the above exemplified compounds, $Ar_1$, $R_1$, $R_2$, and $R_3$ of Formula (A) are each the same, respectively. However, the invention includes a compound having different $Ar_1$, $R_1$, $R_2$, and $R_3$ such that compounds represented by Formula (A') are included in an example of the chemical structure of Formula (1).

CTM-group:

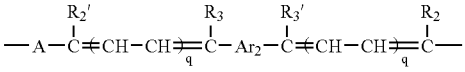

X:

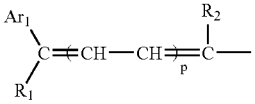

Y:

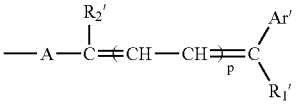

In the formula (A'), $Ar_1$ and $Ar_1'$ are each a substituted or unsubstituted mono-valent aromatic group; $Ar_2$ is a substituted or unsubstituted di-valent aromatic group or a group represented by Formula (2); $R_1$, $R_2$ and $R_3$, and $R_1'$, $R_2'$ and $R_3'$ are each a hydrogen atom, a substituted or unsubstituted alkyl group, or a substituted or unsubstituted mono-valent aromatic group; and A is a divalent group having a trarylamino group or a group represented by Formula (3). $Ar_1$ and $R_1$, and $Ar_1'$ and $R_1'$, may each be bonded to form a ring. P and q are each an integer of 0 or 1.

Chemical structures of typical compounds represented by Formula (A') are shown below. The mixture of compounds represented by the above chemical structure is used as the charge transfer material, in which n has a range of distribution and (Rp+Rs) is not more than 99% when Rp represents the ratio of a component having the maximum content in the mixture and Rs represents the ratio of a component having the content next to the maximum content.

| Chemical structure No. | A | $Ar_1$ | $R_1$ | $Ar_1'$ |
|---|---|---|---|---|
| 43A | 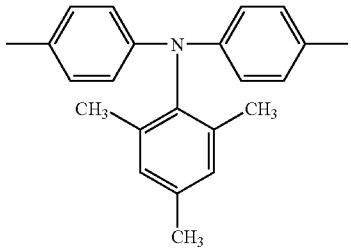 | 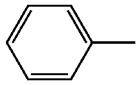 | 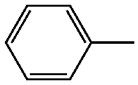 | 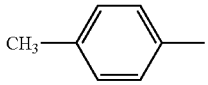 |
| 44A | 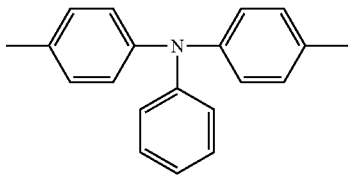 | 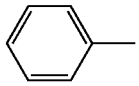 | 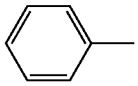 | 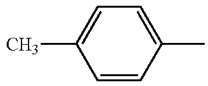 |

| Chemical structure No. | $R_1'$ | $Ar_2$ | $R_2$ | $R_2'$ | $R_3$ | $R_3'$ |
|---|---|---|---|---|---|---|
| 43A | 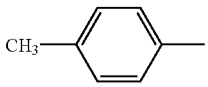 | 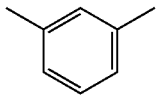 | H | H | H | H |
| 44A | 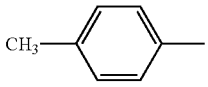 | 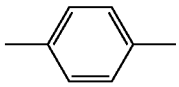 | H | H | H | 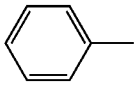 |

Synthesizing Examples of the compounds represented by Formula (A) are described bellow.

In the following synthesizing example, the raw materials are described by attaching the number shown in the scheme of the synthesis of the compound.

SYNTHESIZING EXAMPLE 1

Synthesis of Compound 21A (p=q=0)

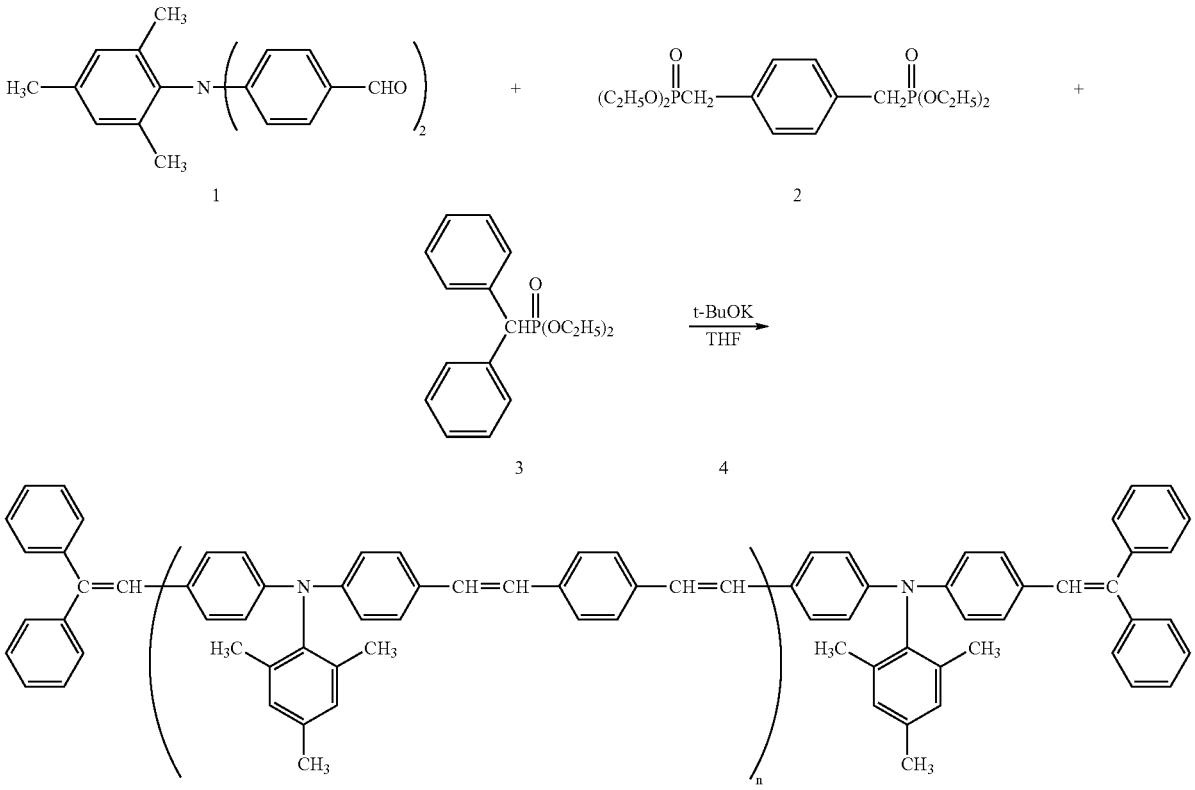

Placed into a 100 ml four-mouth flask equipped with a nitrogen gas inlet pipe, a cooler, a thermometer and a stirrer, were 1.68 g (0.015 moles) of potassium tert-butoxide 4 and 20 ml of tetrahydrofuran, hereinafter referred to as THF, were charged and stirred while introducing nitrogen gas.

A solution was prepared by dissolving 2.06 g (0.006 moles) of Compound 1, and 1.13 g (0.003 moles) of Compound 2 and 1.92 g (0.0063 moles) of Compound 3 dissolved in 20 ml of THF. The solution was gradually dripped into the mixture of potassium tert-butoxide 4 and THF while the temperature was maintained at 45° C. After the dripping, reaction was allowed over 5 hours while maintaining a temperature of from 45 to 50° C.

Into another 200 ml beaker, equipped with a stirrer, 20 ml of methanol was placed and stirred. The reaction liquid after a reaction of 5 hours was poured to the methanol, and 20 ml of water was further added and stirred for 30 minutes, after that the liquid was subjected to filtration. The filtered precipitation was washed with about 40 ml of a mixture of methanol and water at a ratio of 1:1 and dried overnight at a temperature of from 50 to 60° C., whereby unpurified crystals were obtained.

The unpurified crystals were dissolved in 30 ml of toluene, and 3 g of Wakogel B-0, produced by Wako Pure Chemical Industries, Ltd., was added to the solution and stirred for 30 minutes and then filtered. The Wakogel B-0 was washed with 30 ml of toluene. The filtrate and the washing toluene was concentrated and dried. The dried substance was dissolved by adding 10 ml of ethyl acetate, after that solution was dripped into 60 ml of methanol for purifying by re-precipitation. By filtering and drying, 2.54 g of a compound having the chemical structure 21A (p=q=0) was obtained. As a result of analysis via high speed liquid chromatography and mass spectrography, the above-obtained compound was confirmed to be a mixture of compounds having an n of from 0 to 4. The content ratio, that is, area of high speed liquid chromatograph, was n=0/1/2/3/4=25.4/48.8/18.1/6.3/1.4.

The conditions of the high speed liquid chromatography were as follows.

Measuring apparatus: Shimadzu LC6A, manufactured by Shimadzu Seisakusho Co., Ltd.

Column: CLC-ODS, manufactured by Shimadzu Seisakusho Co., Ltd.

Wavelength of detecting light: 290 nm

Moving phase: A mixture solvent of methanol and tetrahydrofuran at a ratio of 3:1.

Flowing velocity of moving phase: About 1 m/min.

The content ratio of the mixture of compounds of the invention is determined by the ratio of the area of each of the components in percent when the total content ratio was 100% after the separation by the high speed liquid chromatography. Regarding the above determining conditions, the measuring apparatus, column and moving phase may be changed as long as the components of the mixture of compounds can be clearly separated and the results the same as the invention can be obtained.

SYNTHESIZING EXAMPLE 2

Synthesis of Compound 21A (p=1, and q=0)

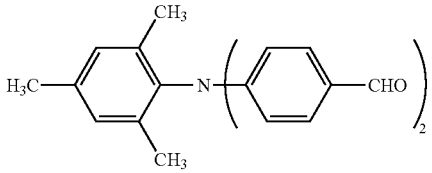

1

+

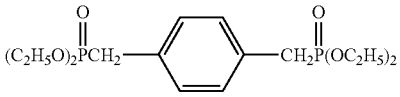

2

+

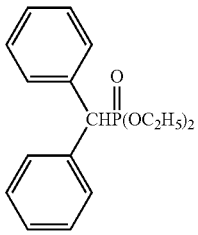

3

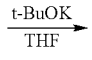

4

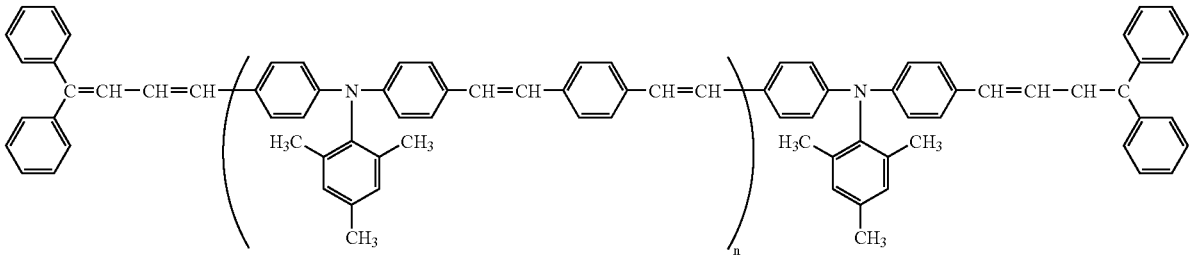

Into a 100 ml four-mouth flask equipped with a nitrogen gas inlet pipe, a cooler, a thermometer and a stirrer, 1.68 g (0.015 moles) of potassium tert-butoxide 4 and 20 ml of tetrahydrofuran, hereinafter referred to as THF, were charged and stirred while introducing nitrogen gas.

A solution was prepared by dissolving 2.06 g (0.006 moles) of Compound 1 and 1.13 g (0.003 moles) of Compound 2 and 2.08 g (0.0063 moles) of Compound 3 dissolved in 20 ml of THF. The solution was gradually dripped into the mixture of potassium tert-butoxide 4 and THF while the temperature was maintained at 45° C. After the finish of the dripping, reaction was allowed over 5 hours while maintaining a temperature of from 45 to 50° C.

To another 200 ml beaker, a stirrer was equipped and 20 ml of methanol was charged and stirred. The reaction liquid after the reaction over 5 hours was poured to the methanol, and 20 ml of water was further added and stirred for 30 minutes. Thereafter the liquid was subjected to filtration. The filtered precipitation was washed by about 40 ml of a mixture of methanol and water at a ratio of 1:1 and dried for one night at a temperature of from 50 to 60° C. Thus unpurified crystals were obtained.

The unpurified crystals were dissolved in 30 ml of toluene, and 3 g of Wakogel B-0, produced by Wako Pure Chemical Industries, Ltd., was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dripped into 60 ml of methanol for purifying by re-precipitation. By filtering and drying, 2.75 g of a compound having the chemical structure 21A (p=1 and q=0) was obtained. As a result of analysis by high speed liquid chromatography and mass spectrography, the above-obtained compound is a mixture of compounds having an n of from 0 to 4. The content ratio or area of high speed liquid chromatograph was n=0/1/2/3/4=33.4/46.8/15.0/4.0/0.8.

SYNTHESIZING EXAMPLE 3

Synthesis of Compound 14A (p=1 and q=0)

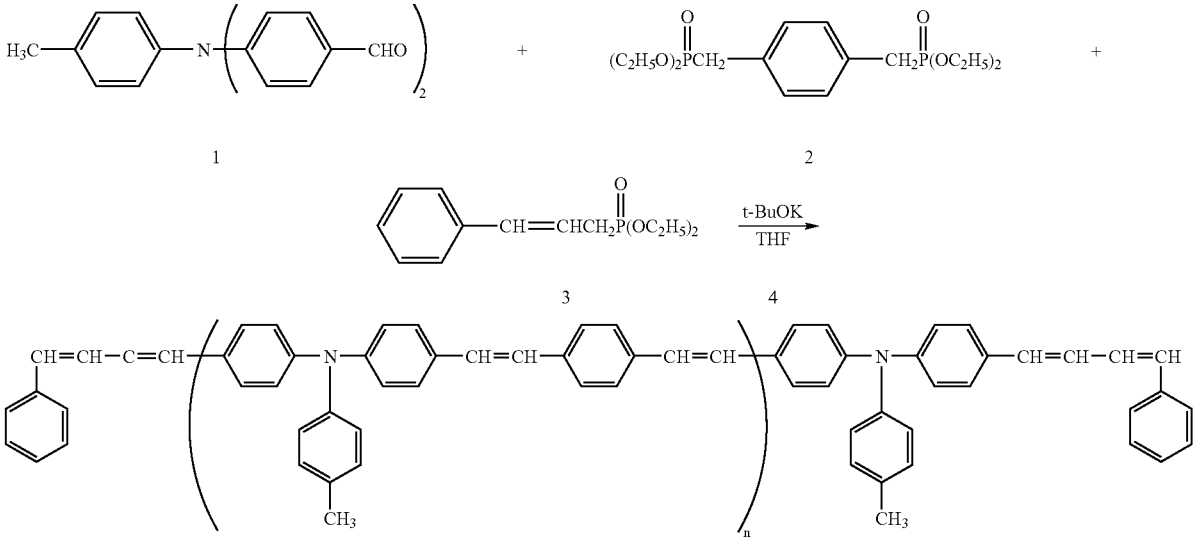

Into a 100 ml four-mouth flask to which a nitrogen gas inlet pipe, a cooler, a thermometer and a stirrer were equipped, 1.68 g (0.015 moles) of 4(potassium-tert-butoxide) and 20 ml of tetrahydrofuran, hereinafter referred to as THF, were charged and stirred while introducing nitrogen gas.

A solution was prepared by dissolving 1.89 g (0.006 moles) of Compound 1 and 1.13 g (0.003 moles) of Compound 2 and 1.60 g (0.0063 moles) of Compound 3 dissolved in 20 ml of THF. The solution was gradually dripped into the mixture of 4 (potassium-tert-butoxide) and THF while the temperature was maintained at 45° C. After the finish of the dripping, reaction was allowed over 5 hours while maintaining a temperature of from 45 to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water at a ratio of 1:1 and dried for one night at a temperature of from 50 to 60° C. Thus unpurified crystals were obtained.

The unpurified crystals were dissolved in 30 ml of toluene, and 3 g of Wakogel B-0, produced by Wako Pure Chemical Industries, Ltd., was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dripped into 60 ml of methanol for purifying by re-precipitation. By filtering and drying, 2.32 g of a compound having the chemical structure 14A (p=1 and q=0) was obtained. As a result of analysis by high speed liquid chromatography and mass spectrography, the above-obtained compound is a mixture of compounds having an n of from 0 to 4. The content ratio or area of high speed liquid chromatograph was n=0/1/2/3/4=30.1/45.4/16.7/6.0/1.8.

SPECIFIC EXAMPLES OF FORMULA (B)

| Chemical structure No. | A | B |
|---|---|---|
| 1B | 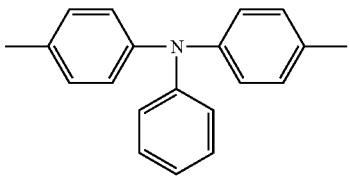 | 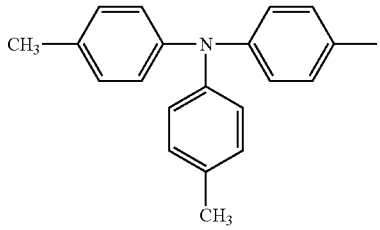 |

-continued
2B
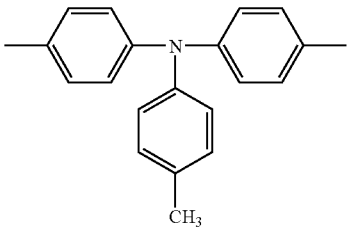
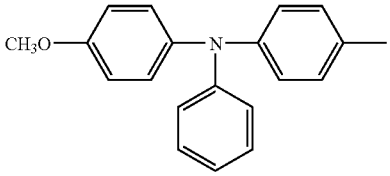
3B
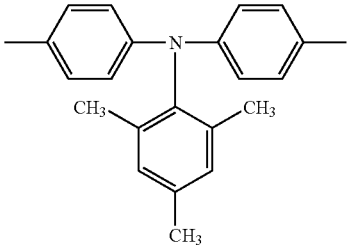
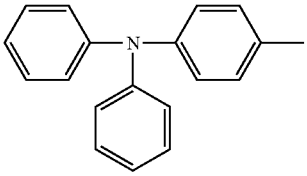
4B
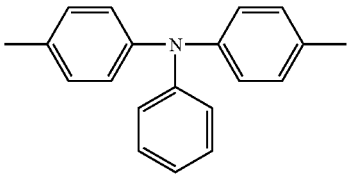
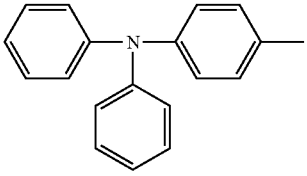
5B
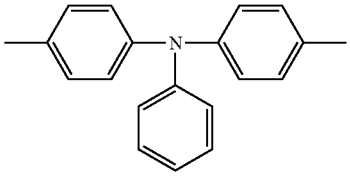
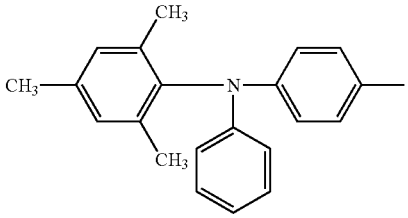
6B
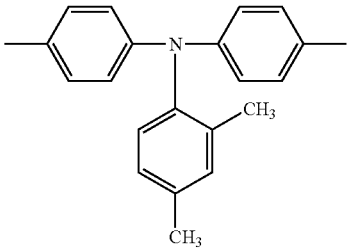
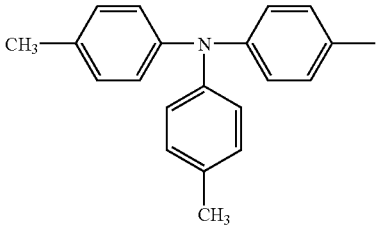
7B
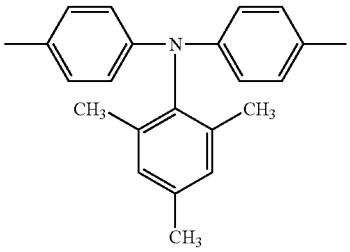
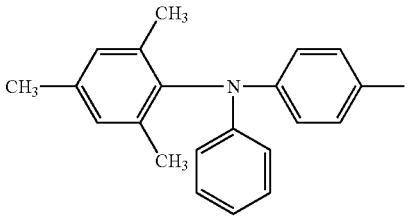

-continued
| | | |
|---|---|---|
| 8B | 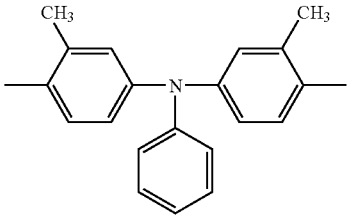 | 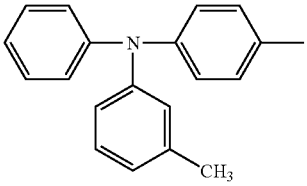 |
| 9B | 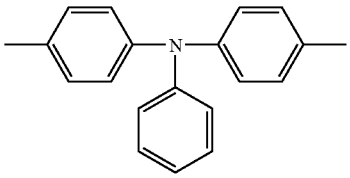 | 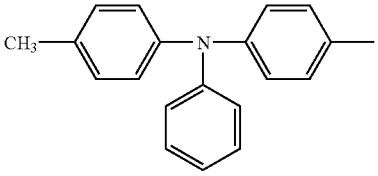 |
| 10B | 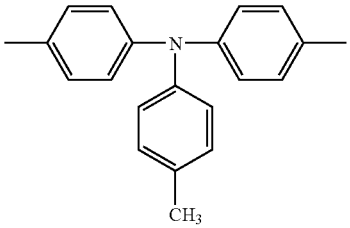 | 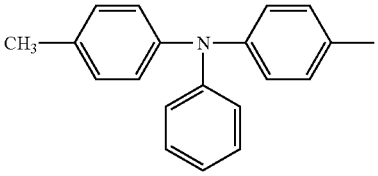 |
| 11B | 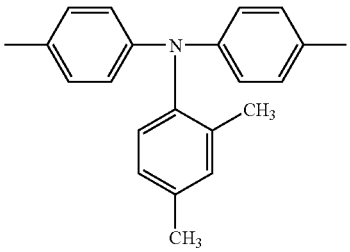 | 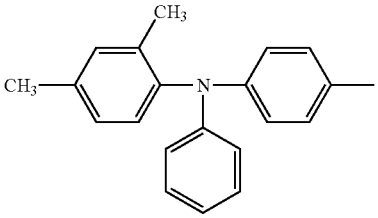 |
| 12B | 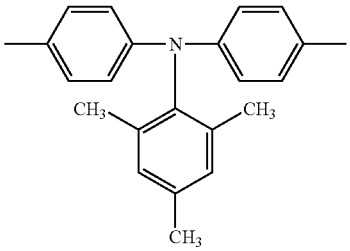 | 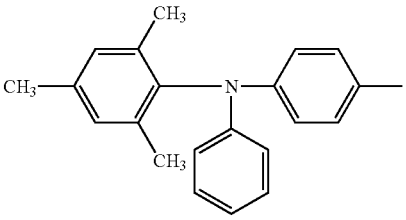 |
| 13B | 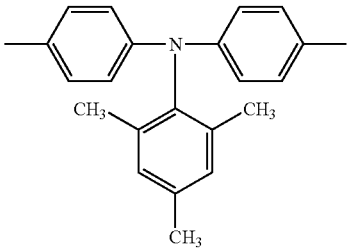 | 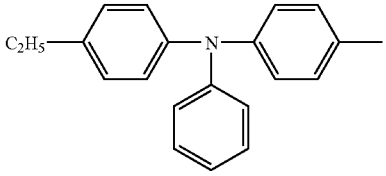 |

-continued
14B
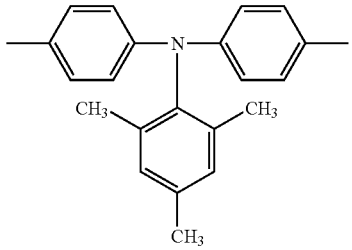
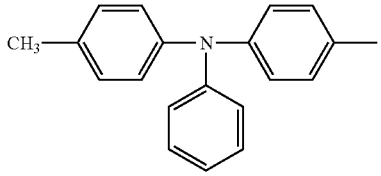
15B
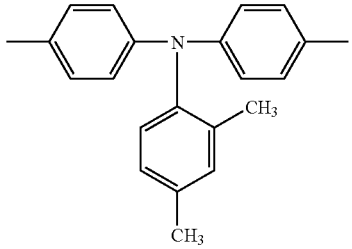
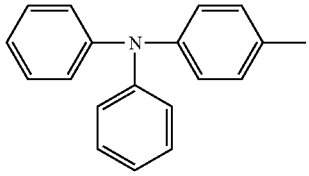
16B
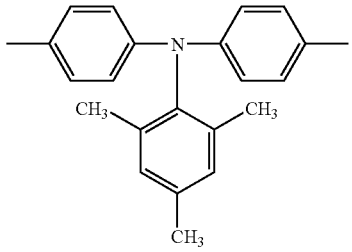
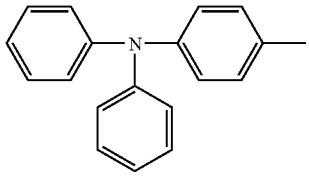
17B
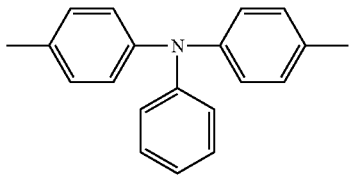
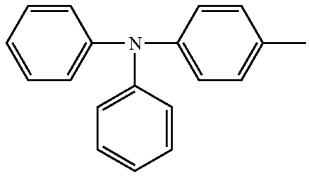
18B
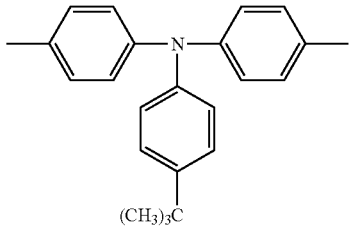
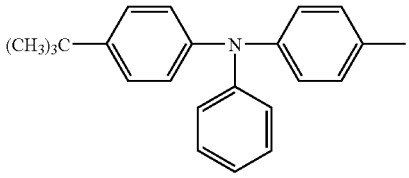
19B
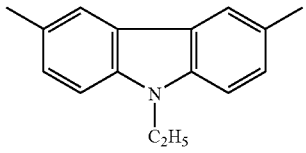
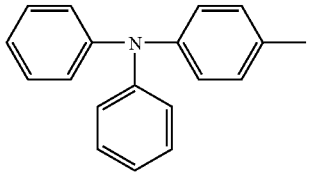
20B
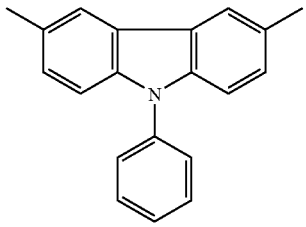
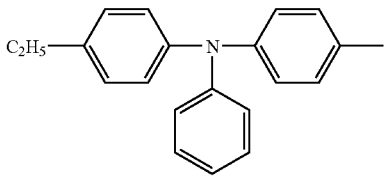

-continued
21B
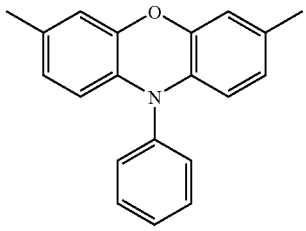
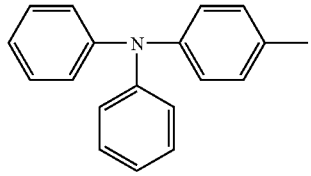
22B
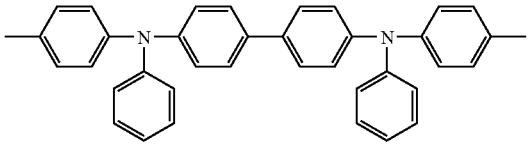
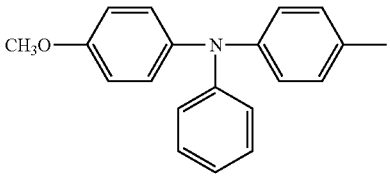
23B
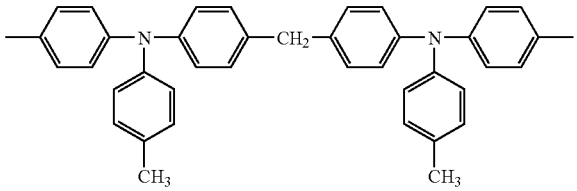
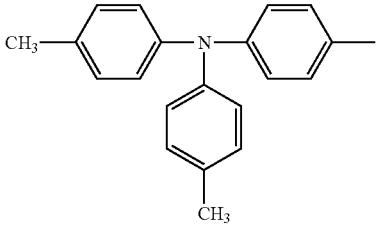
24B
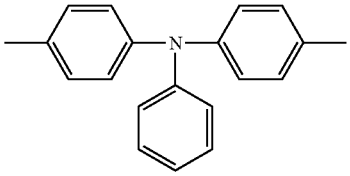
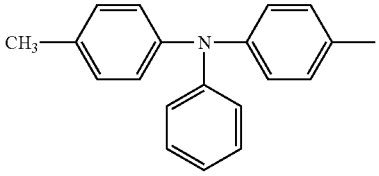
25B
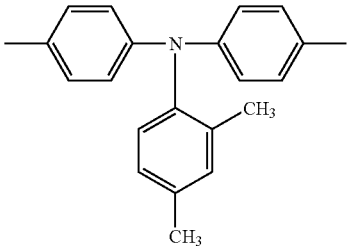
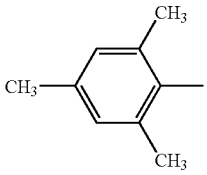
26B
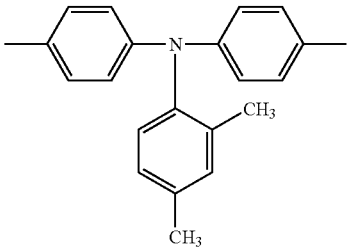
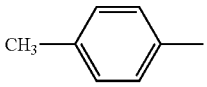
27B
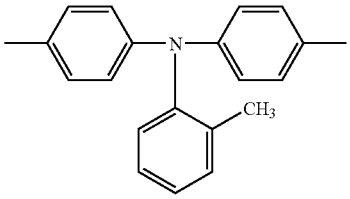
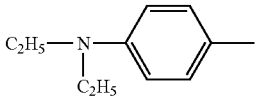

-continued
| | | |
|---|---|---|
| 28B | 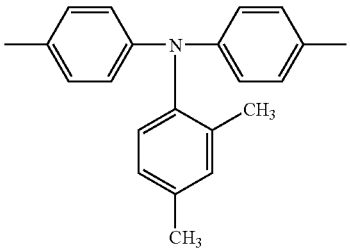 | 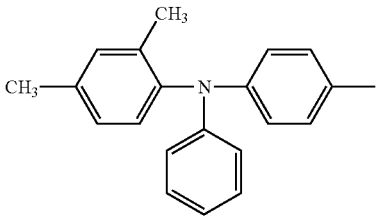 |
| 29B | 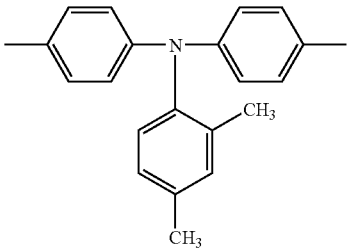 | 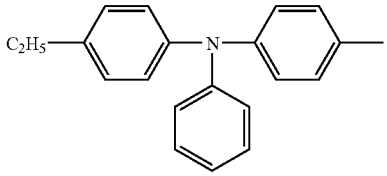 |
| 30B | 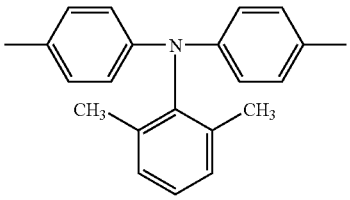 | 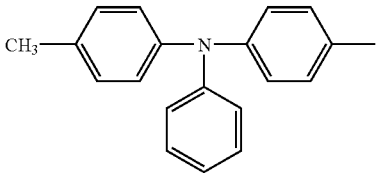 |
| Chemical structure No. | $Ar_2$ | $R_1$ | $R_2$ | $R_3$ |
|---|---|---|---|---|
| 1B | 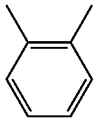 | H | H | H |
| 2B | 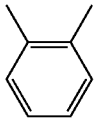 | H | H | H |
| 3B | 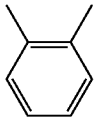 | H | H | H |
| 4B | 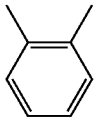 | H | 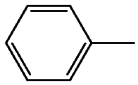 | H |
| 5B | 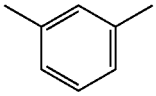 | H | H | H |
| 6B | 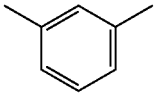 | H | H | H |

-continued
| | | | | |
|---|---|---|---|---|
| 7B | 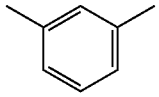 | H | H | H |
| 8B | 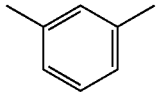 | H | 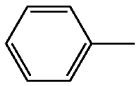 | H |
| 9B | 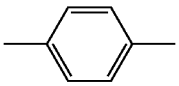 | H | H | H |
| 10B | 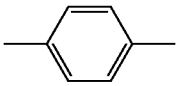 | H | H | H |
| 11B | 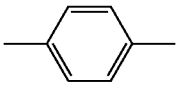 | H | H | H |
| 12B | 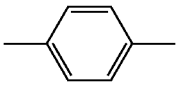 | H | H | H |
| 13B | 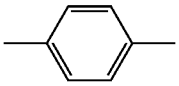 | H | H | H |
| 14B | 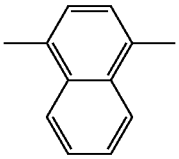 | H | H | H |
| 15B | 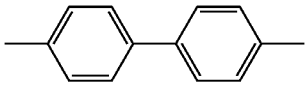 | H | H | H |
| 16B | 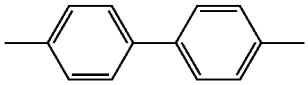 | H | H | H |
| 17B | 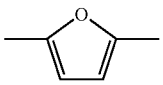 | H | H | H |
| 18B | 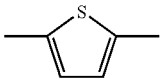 | H | H | H |
| 19B | 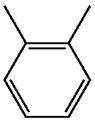 | H | H | H |
| 20B | 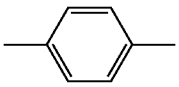 | H | H | H |

-continued

| | | | | |
|---|---|---|---|---|
| 21B | 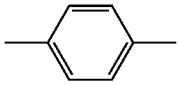 | H | H | H |
| 22B | 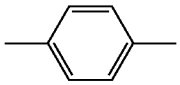 | H | H | H |
| 23B | 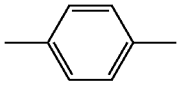 | H | H | H |
| 24B | 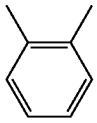 | H | H | $CH_3$— |
| 25B | 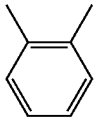 | H | H | H |
| 26B | 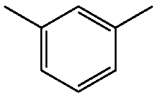 | H | H | H |
| 27B | 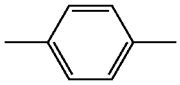 | 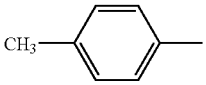 | H | H |
| 28B | 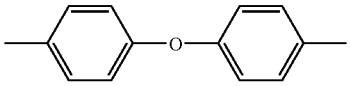 | H | H | H |
| 29B | 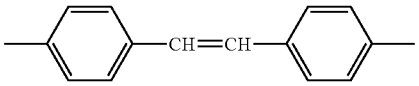 | H | H | H |
| 30B | 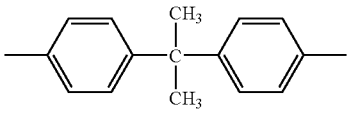 | H | H | H |

The above-described exemplified compounds are examples of the compound in which plural B, $R_1$, $R_2$ and $R_3$ in Formula (B) are each the same. However, compounds in which plural B, $R_1$, $R_2$ and $R_3$ are each different from the other are included in the invention. For example, the following compounds represented by Formula (B') are also included in the invention as the compound represented by Formula (B).

Formula (B')

CTM-group 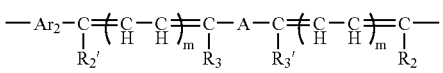

X 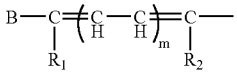

-continued

Y 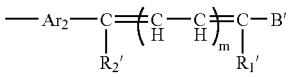

In Formula (B'), $Ar_2$ is a substituted or unsubstituted di-valent aromatic group, a furan group or a thiophene; $R_1$, $R_2$ and $R_3$, and $R_1'$, $R_2'$ and $R_3'$ are each a hydrogen atom, a substituted or unsubstituted alkyl group and a substituted or unsubstituted mono-valent aromatic group; and A is a divalent group having a trarylamino group or a group represented by Formula (3). B and B' are each a substituted or unsubstituted aromatic group. m is each an integer of 0 or 1.

31B
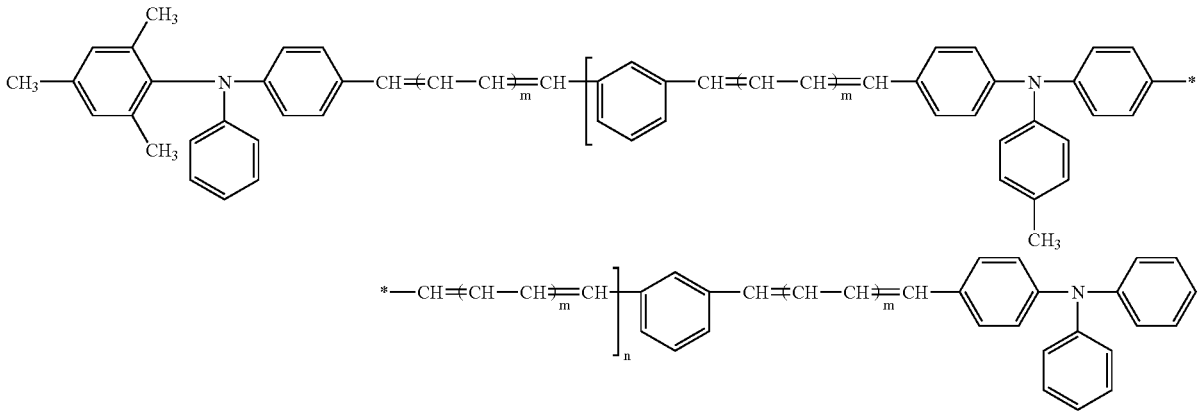
32B
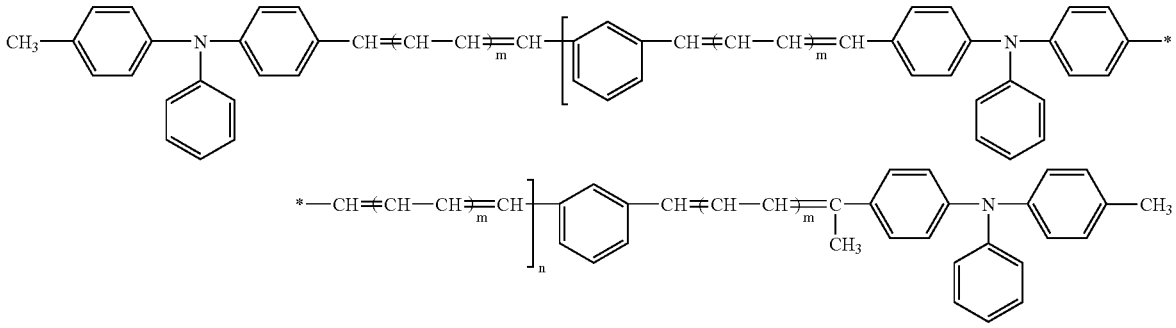
Synthesizing examples of compound represented by Formula (B) are shown below.
SYNTHESIZING EXAMPLE 4
Synthesis of Compound 12B (m=0)
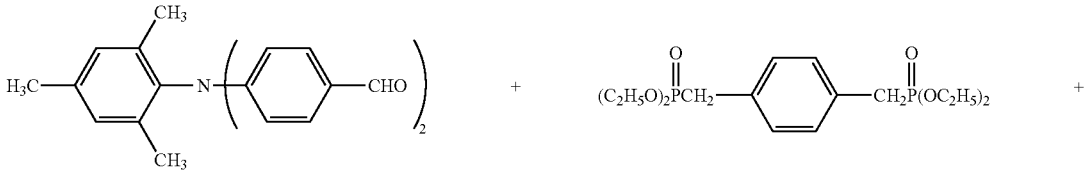
1 2
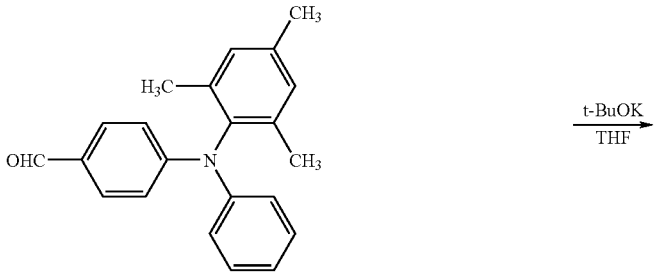
3 4

-continued

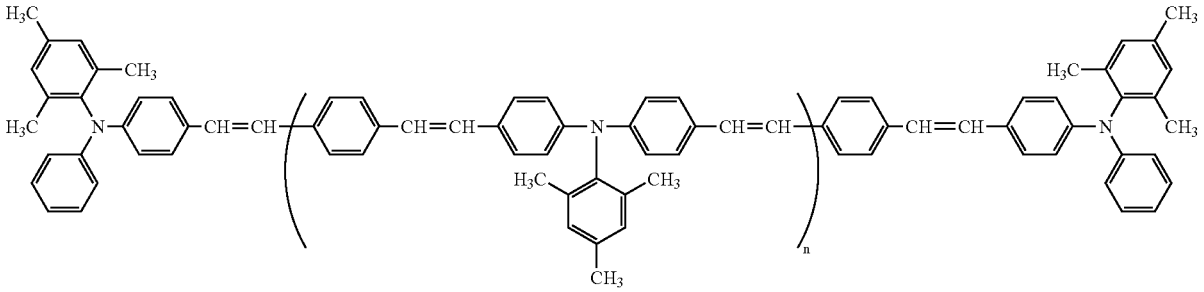

Into a 100 ml four-mouth flask to which a nitrogen gas inlet pipe, a cooler, a thermometer and a stirrer were equipped, 1.96 g (0.075 moles) of potassium tert-butoxide 4 and 20 ml of tetrahydrofuran, hereinafter referred to as THF, were charged and stirred while introducing nitrogen gas.

A solution was prepared by dissolving 1.0 g (0.003 moles) of Compound 1 and 2.63 g (0.007 moles) of Compound 2 and 2.25 g (0.008 moles) of Compound 3 dissolved in 20 ml of THF. The solution-was gradually dripped into the mixture of potassium tert-butoxide 4 and THF while the temperature was maintained at 45° C. After the finish of the dripping, reaction was carried out for 5 hours while maintaining a temperature of from 45 to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water at a ratio of 1:1 and dried for one night at a temperature of from 50 to 60° C. Thus unpurified crystals were obtained.

The unpurified crystals were dissolved in 30 ml of toluene, and 3 g of Wakogel B-0, produced by Wako Pure Chemical Industries, Ltd., was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dripped into 60 ml of methanol for purifying by re-precipitation. By filtering and drying, 3.20 g of a compound having the chemical structure 12B (m=0) was obtained.

As a result of analysis by high speed liquid chromatography and mass spectrography in the same manner as in Synthesizing Example 1A, the above-obtained compound is a mixture of compounds having an n of from 0 to 5. The content ratio or area of high speed liquid chromatograph was n=0/1/2/3/4/5=24.3/44.4/21.5/7.2/2.3/0.3.

The determination condition of the high speed chromatography was carried out under the following conditions.

SYNTHESIZING EXAMPLE 5

Synthesis of Compound 11B (m=0)

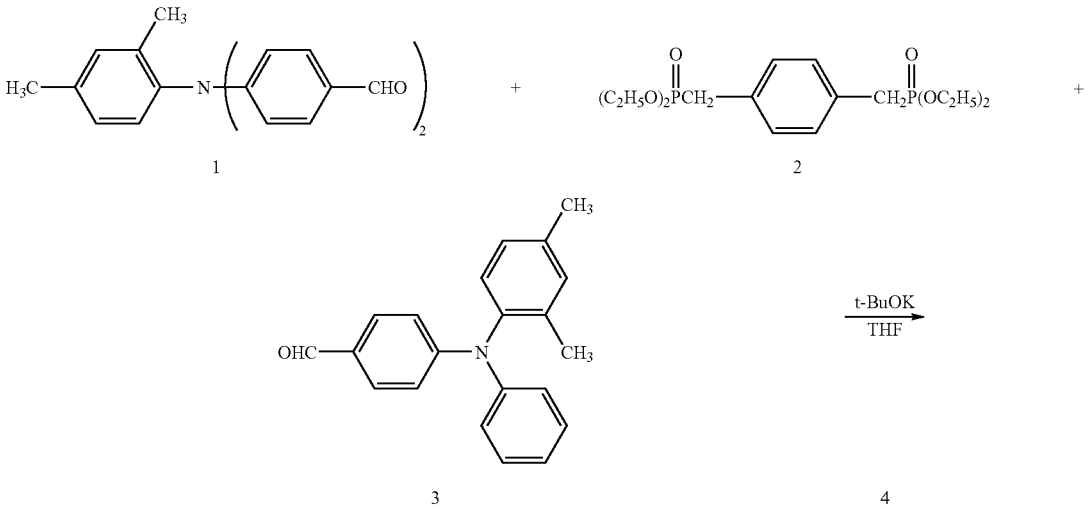

-continued

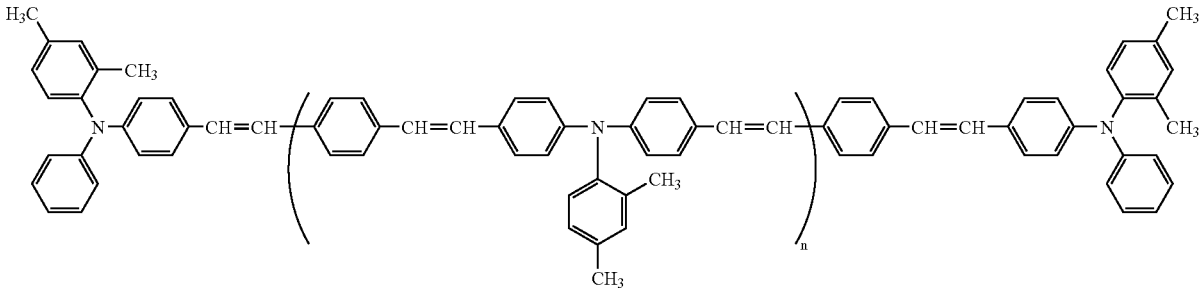

Into a 100 ml four-mouth flask to which a nitrogen gas inlet pipe, a cooler, a thermometer and a stirrer were equipped, 1.96 g (0.075 moles) of potassium tert-butoxide 4 and 20 ml of tetrahydrofuran, hereinafter referred to as THF, were charged and stirred while introducing nitrogen gas.

A solution was prepared by dissolving 1.0 g (0.003 moles) of Compound 1 and 2.46 g (0.007 moles) of Compound 2 and 2.41 g (0.008 moles) of Compound 3 dissolved in 20 ml of THF. The solution was gradually dripped into the mixture of potassium tert-butoxide 4 and THF while the temperature was maintained at 45° C. After the finish of the dripping, reaction was carried out for 5 hours while maintaining a temperature of from 45° C. to 50° C.

To another 200 ml beaker, a stirrer was equipped and 20 ml of methanol was charged and stirred. The reaction liquid after the reaction for 5 hours was poured to the methanol, and 20 ml of water was further added and stirred for 30 minutes. Thereafter the liquid was subjected to filtration. The filtered precipitation was washed by about 40 ml of a mixture of methanol and water at a ratio of 1:1 and dried for one night at a temperature of from 50° C. to 60° C. Thus unpurified crystals were obtained.

The unpurified crystals were dissolved in 30 ml of toluene, and 3 g of Wakogel B-0, produced by Wako Pure Chemical Industries, Ltd., was added to the solution and stirred for 30 minutes and filtered. The Wakogel B-0 was washed by 30 ml of toluene. The filtrate and the washing toluene was concentrated and dried. The dried substance was dissolved by adding 10 ml of ethyl acetate. The solution was dripped into 60 ml of methanol for purifying by re-precipitation. By such filtering and drying, 3.35 g of a compound having the chemical structure of 11B (m=0) was obtained.

As a result of analysis by high speed liquid chromatography and mass spectrography in the same manner as in Synthesizing Example 1A, the above-obtained compound is a mixture of compounds having an n of from 0 to 4. The content ratio or area of high speed liquid chromatograph was n=0/1/2/3/4=32.5/45.0/16.5/6.2/1.6.

The compounds represented by Formula (C) each have the following chemical structure.

Formula (C)

CTM-group: 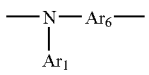

-continued

X: R—

Y: 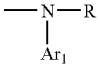

In Formula (C), $Ar_1$ is a substituted or unsubstituted mono-valent aromatic group; $Ar_6$ is a substituted or unsubstituted di-valent aromatic group, a di-valent heterocyclic group, or a group represented by Formula (8); and R is a substituted or unsubstituted alkyl group or a substituted or unsubstituted mono-valent aromatic group. Each of $Ar_1$, $Ar_6$ and R differs from each other.

Formula (8)

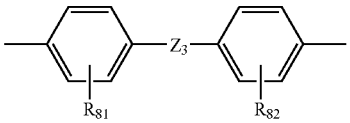

In Formula (8), $Z_3$ is an oxygen atom, a sulfur atom, a —CH═CH— group or a —$CH_2$—$CH_2$— group; and $R_1$ and $R_1$ are each a hydrogen atom or an alkyl group having from 1 to 4 carbon atoms.

In Formula (C), $Ar_1$ is a substituted or unsubstituted mono-valent aromatic group, and is preferably a substituted or unsubstituted phenyl group, a phenyl group substituted with an alkyl group having from 1 to 4 carbon atoms, or an alkoxyl group.

The substituted or unsubstituted divalent aromatic group represented by $Ar_6$ is preferably a phenylene group, a naphthylene group or a bi-phenylene group, and the substituent of them is preferably an alkyl group. As the di-valent heterocyclic group represented by $Ar_6$, a di-valent furan group or a di-valent thiophene group are preferable.

SPECIFIC EXAMPLES OF THE COMPOUND OF FORMULA (C)
| Chemical structure No. | $Ar_1$ | $Ar_6$ | R |
|---|---|---|---|
| 1C | 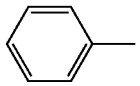 | 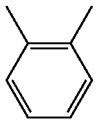 | 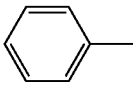 |
| 2C | 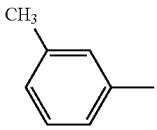 | 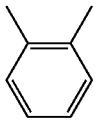 | 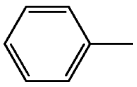 |
| 3C | 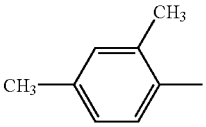 | 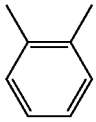 | 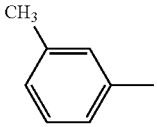 |
| 4C | 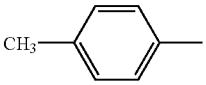 | 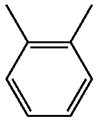 | $CH_3$— |
| 5C | 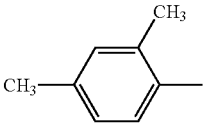 | 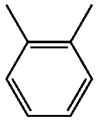 | 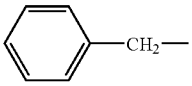 |
| 6C | 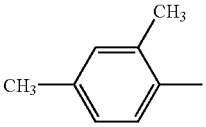 | 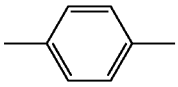 | 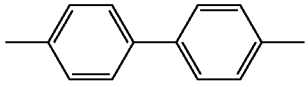 |
| 7C | 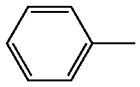 | 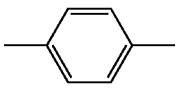 | 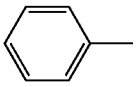 |
| 8C | 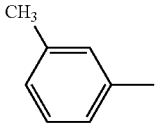 | 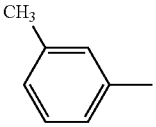 | 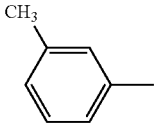 |
| 9C | 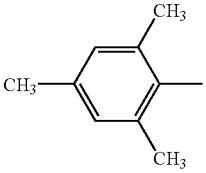 | 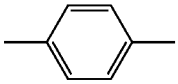 | 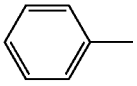 |
| 10C | 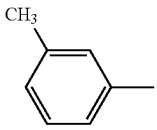 | 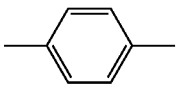 | 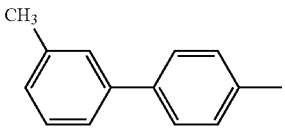 |

-continued
| Chemical structure No. | $Ar_1$ | $Ar_6$ | R |
|---|---|---|---|
| 11C | 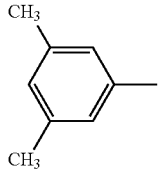 | 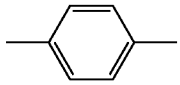 | $C_2H_5$— |
| 12C | 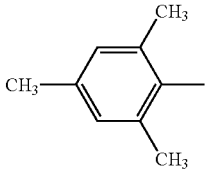 | 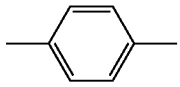 | 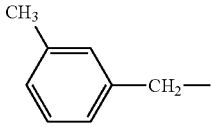 |
| 13C | 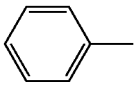 | 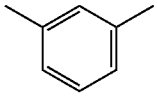 | 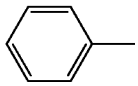 |
| 14C | 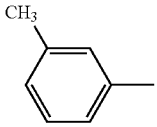 | 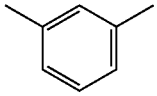 | 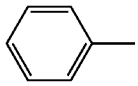 |
| 15C | 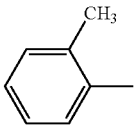 | 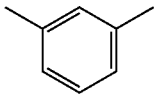 | 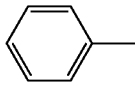 |
| 16C | 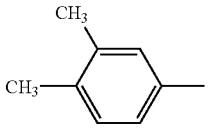 | 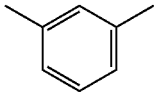 | 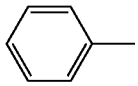 |
| 17C | 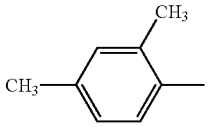 | 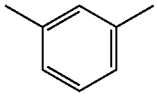 | 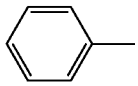 |
| 18C | 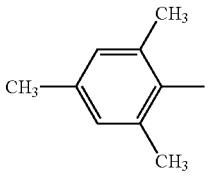 | 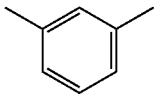 | 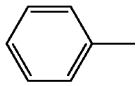 |
| 19C | 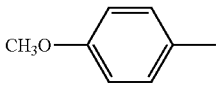 | 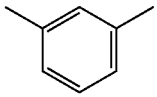 | 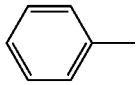 |
| 20C | 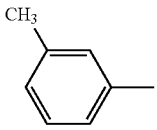 | 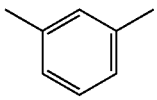 | 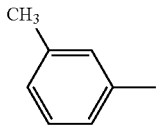 |

-continued
| Chemical structure No. | $Ar_1$ | $Ar_6$ | R |
|---|---|---|---|
| 21C | 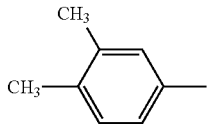 | 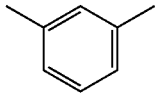 | 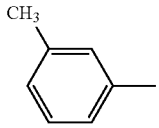 |
| 22C | 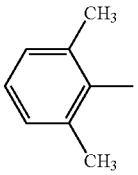 | 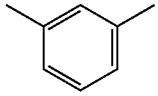 | 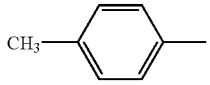 |
| 23C | 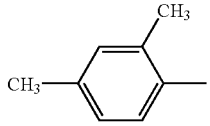 | 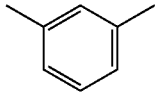 | 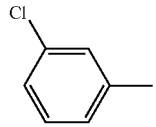 |
| 24C | 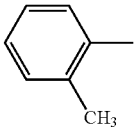 | 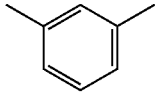 | 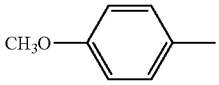 |
| 25C | 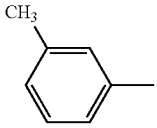 | 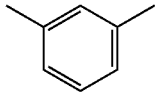 | 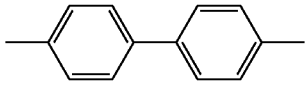 |
| 26C | 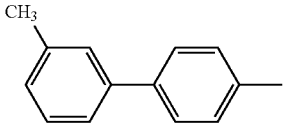 | 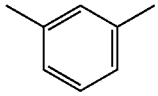 | 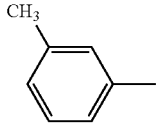 |
| 27C | 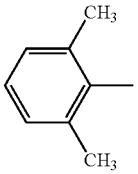 | 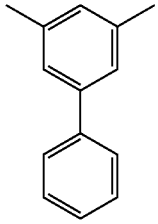 | 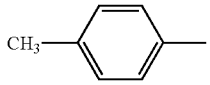 |
| 28C | 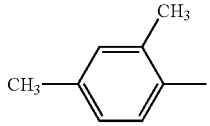 | 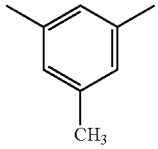 | 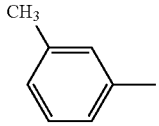 |
| 29C | 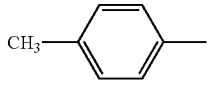 | 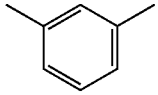 | $CH_3$— |

-continued
| Chemical structure No. | $Ar_1$ | $Ar_6$ | R |
|---|---|---|---|
| 30C | 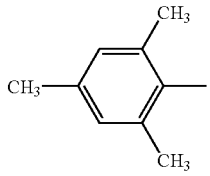 | 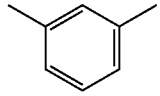 | 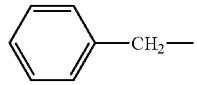 |
| 31C | 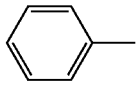 | 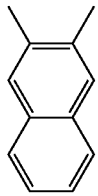 | 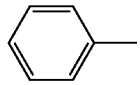 |
| 32C | 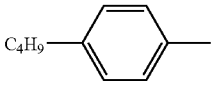 | 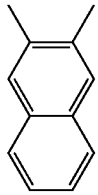 | 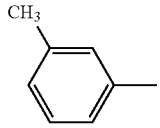 |
| 33C | 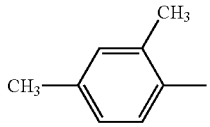 | 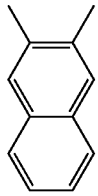 | $CH_3$— |
| 34C | 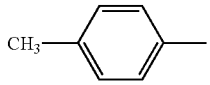 | 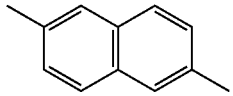 | 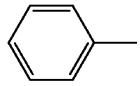 |
| 35C | 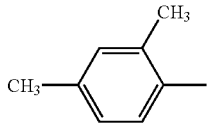 | 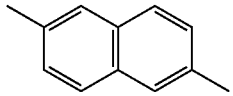 | 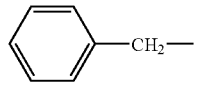 |
| 36C | 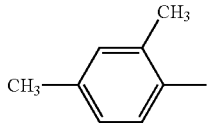 | 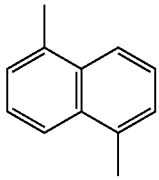 | 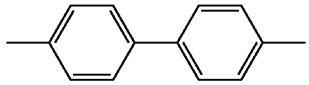 |
| 37C | 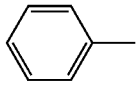 | 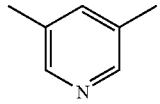 | 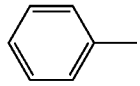 |
| 38C | 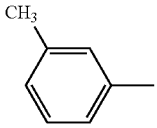 | 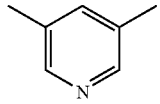 | 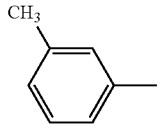 |

-continued
| Chemical structure No. | $Ar_1$ | $Ar_6$ | R |
|---|---|---|---|
| 39C | 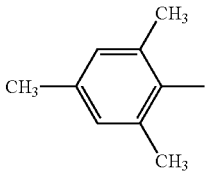 | 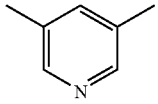 | 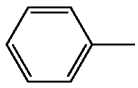 |
| 40C | 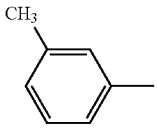 | 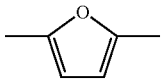 | 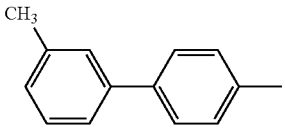 |
| 41C | 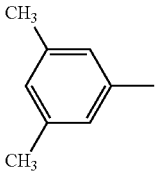 | 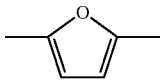 | $C_2H_5$— |
| 42C | 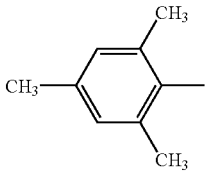 | 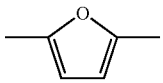 | 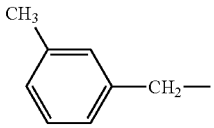 |
| 43C | 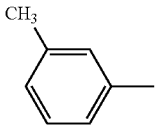 | 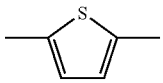 | 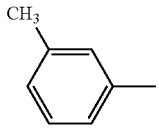 |
| 44C | 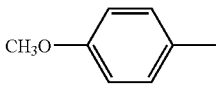 | 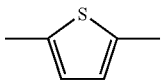 | 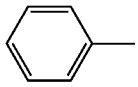 |
| 45C | 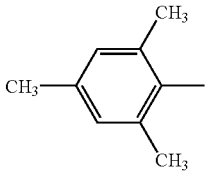 | 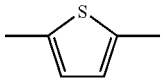 | 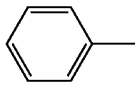 |
| 46C | 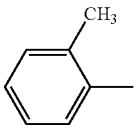 | 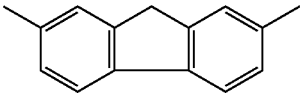 | 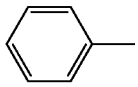 |
| 47C | 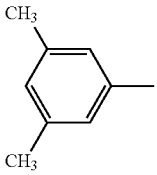 | 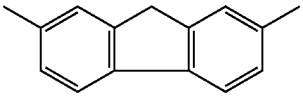 | 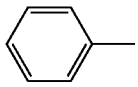 |

-continued
| Chemical structure No. | $Ar_1$ | $Ar_6$ | R |
|---|---|---|---|
| 48C | 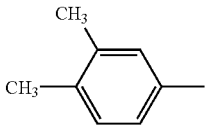 | 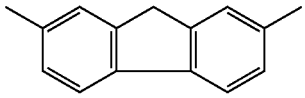 | 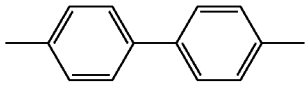 |
| 49C | 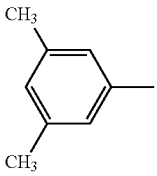 | 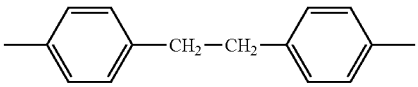 | 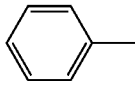 |
| 50C | 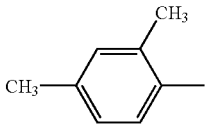 | 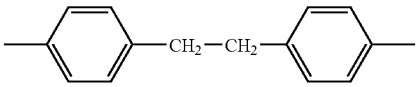 | 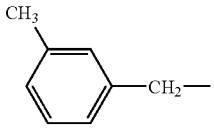 |
| 51C | 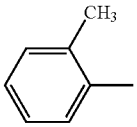 | 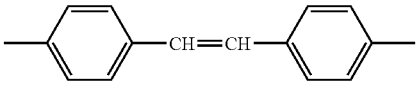 | 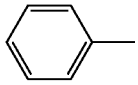 |
| 52C | 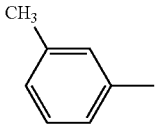 | 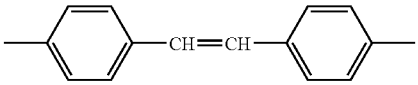 | 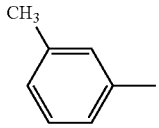 |
| 53C | 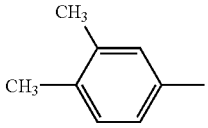 | 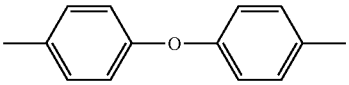 | 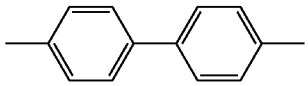 |
| 54C | 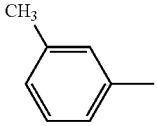 | 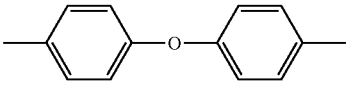 | 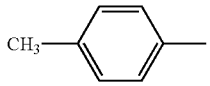 |
| 55C | 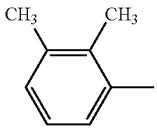 | 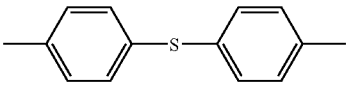 | 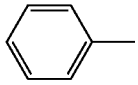 |
| 56C | 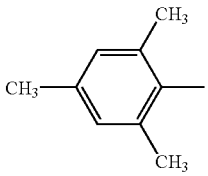 | 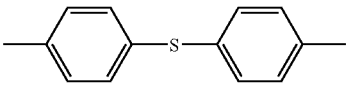 | $(CH_3)_3$— |

The synthesizing example of compounds represented by Formula (C) is described below.

SYNTHESIZING EXAMPLE 6

Synthesize of Compound 17C

Into a 100 ml four-mouth flask-to which a nitrogen gas inlet pipe, a cooler, a thermometer and a stirrer were equipped, 4.08 g (0.04 moles) of 2,4-dimethylaniline, 4.08 g (0.02 moles) of iodobenzene, 9.9 g (0.03 moles) of di-iodobenzene, 1.27 g (0.02 moles) of powdered copper and 11.04 g (0.08 moles) of potassium carbonate were charged and reacted over 30 hours at 190° C. while introducing nitrogen gas.

The reaction liquid was cooled to 60° C. and 200 ml of THF was added to the liquid, and the mixture was filtered. The filtrate was concentrated and dissolved in 100 ml of toluene and 10 g of Wakogel B-0 (Wako Pure Chemical Industries, Ltd.) was added, and stirred for 30 minutes and filtered. Filtered Wakogel was washed by 30 ml of toluene. The filtrate and the washing liquid were concentrated and dried. The dried substance was dissolved in 20 ml of THF and the solution was dripped into 120 ml of methanol for purifying by re-precipitation. The precipitate was filtered and dried, thus 5.15 g of Compound 17C was obtained.

According to the results of the analysis by high speed liquid chromatography and mass spectrography, the above-obtained compound has a composition of n=0/1/2/3/4/5/6/7=2.7/9.0/24.3/34.2/20.1/7.8/1.7/0.2. The weight average molecular weight (in terms of polystyrene) Mw of the compound measured via gel permeation chromatography (GPC) was 910.

SYNTHESIZING EXAMPLE 7

Synthesis of Compound 48C

Charged into a 100 ml four-mouth flask equipped with a nitrogen gas inlet pipe, a cooler, a thermometer and a stirrer, were 6.05 g (0.05 moles) of 2,4-dimethylaniline, 5.60 g (0.02 moles) of iodobiphenyl, 13.11 g (0.04 moles) of bis(4-bromophenyl) ether, 1.59 g (0.025 moles) of copper powder and 13.8 g (0.1 moles) of potassium carbonate were charged and reacted for 30 hours at 190° C. while introducing nitrogen gas.

The reacting liquid was cooled to 60° C. and 200 ml of THF was added to the liquid and the mixture was filtered. The filtrate was concentrated and dissolved by 100 ml of toluene and 10 g of Wakogel B-0 (Wako Pure Chemical Industries, Ltd.) was added, and stirred for 30 minutes and filtered. Filtered Wakogel was washed with 30 ml of toluene. The filtrate and the washing liquid were concentrated and dried. The dried substance was dissolved by adding 20 ml of THF, and the solution was dripped into 120 ml of methanol for purifying by re-precipitation. The precipitate was filtered and dried, whereby 10.56 g of Compound 48C was obtained.

Based on the results of analysis via high speed liquid chromatography and mass spectrography, the above-obtained compound has a composition of n=0/1/2/3/4/5/6/7/8=0.9/3.4/12.0/22.8/31.3/19.9/6.9/2.5/0.3. The weight average molecular weight in terms of polystyrene Mw of the compound measured by gel permeation chromatography (GPC) was 1684.

The charge transfer material according to the invention contains the mixture of compounds represented by Formula (1) in which n has a range of distribution and (Rp+Rs) is not more than 99% when Rp represents the ratio of a component having the maximum content in the mixture and Rs represents the ratio of a component having the content next to the maximum content. The value of (Rp+Rs) is preferably from 30% to 99%, and more preferably from 45% to 90%, wherein distribution of n and the molecular weight are adequate and preferable solubility and compatibility of the solvent or the binder resin are obtained.

The value of n is from 0 to 10, but a composition having an n of 11 or more may be viable. It is acceptable that the component of maximum content in the mixture and that of content next to the maximum content are within the range of from 0 to 10 and (Rp+Rs) is not more than 99%.

The average molecular weight of the mixture of compounds is preferably from 650 to 2,500, and more preferably from 800 to 2,300. The average molecular weight is represented by the weight average molecular weight in terms of polystyrene. By employing compounds having such average molecular weight, adequate solubility in the solvent and compatibility with the binder resin of the charge transfer layer are obtained, so that the dispersibility of the charge transfer material and good electrophotographic properties of the photoreceptor such as the sensitivity and the charge uniformity are obtained, and in particular, preferable sensitivity and high responsibility are obtained.

An anti-oxidant, having such a partial group as hindered phenol, hindered amine, thioether and phosphite, may be added to the CTL to improve stability against circumstance variation or image quality.

Examples of the anti-oxidant having a partial group of hindered phenol is disclosed at pages 7–14 of JP O.P.I. Publication No. 1-118137.

Examples of the anti-oxident having a partial group of hindered amine is disclosed at pages 7–9 of JP O.P.I. Publication No. 1-118138.

Typical examples of the antioxidant are as follows.

1-1

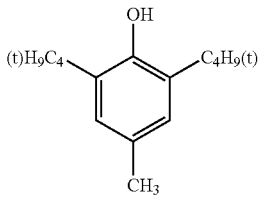

1-2

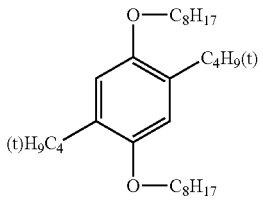

1-3

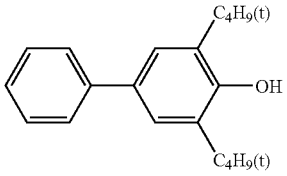

-continued
1-4
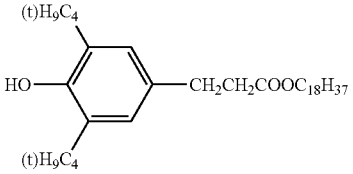
1-5
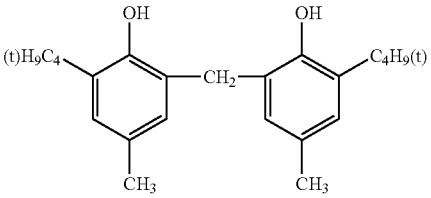
1-6
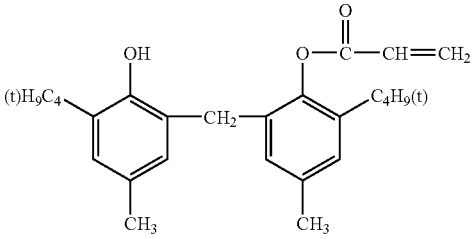
1-7
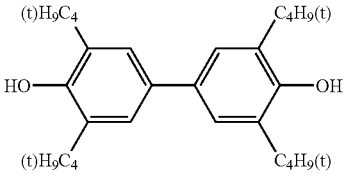
1-8
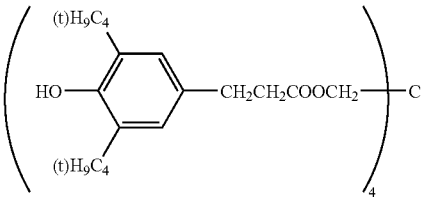
1-9
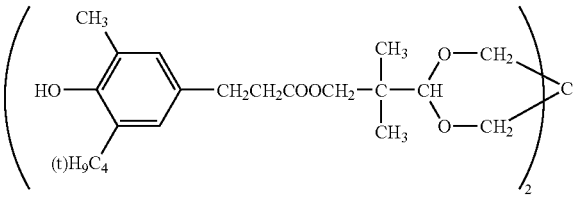
1-10
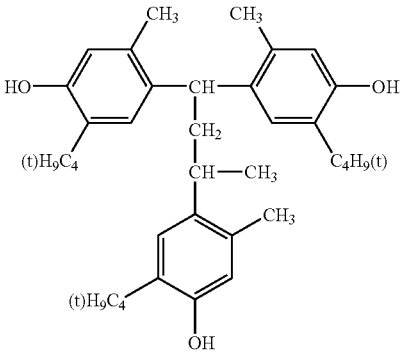
-continued
2-1
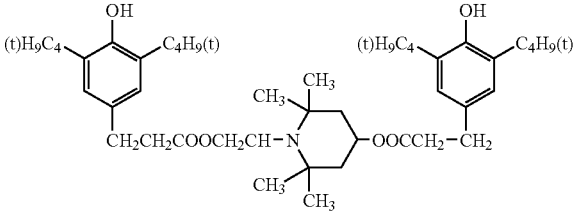
2-2
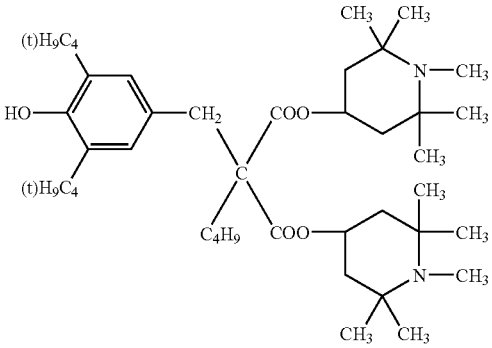
2-3
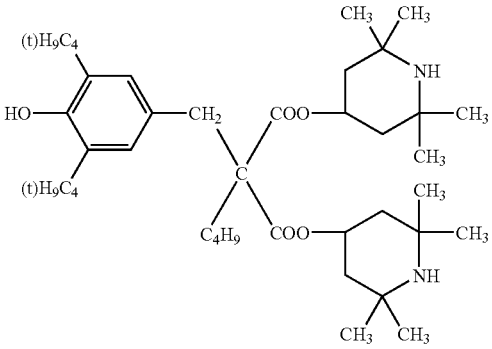
2-4
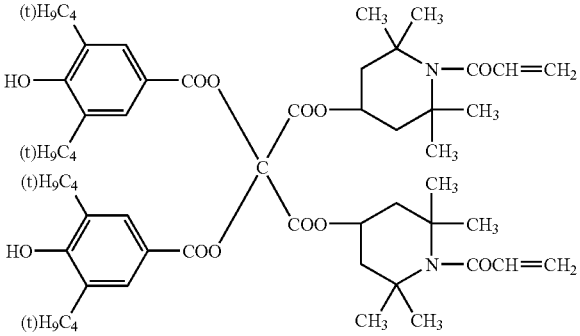
2-5
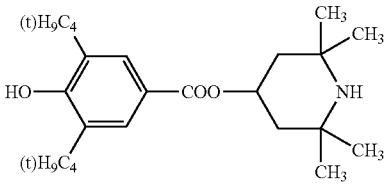

-continued 2-6

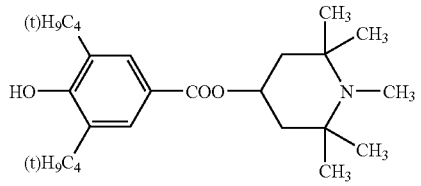

2-7

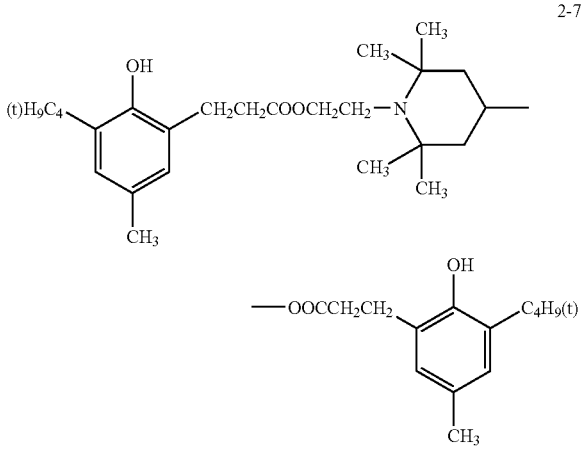

Hindered phenol type antioxidant: Ilganox 1076, Ilganox 1010, Ilganox 1098, Ilganox 245, Ilganox 1330, Ilganox 3114, Ilganox 1076, and 3,5-di-t-butyl-4-hydroxybiphenyl.

Hindered amine type antioxidant: SANOL LS2626, SANOL LS765, SANOL LS770, SANOL LS744, Tinuvin 144, Tinuvin 622LD, Mark LA57, Mark LA67, Mark LA62, Mark LA68 and Mark LA63.

Thioether type antioxidant: Sumirizer TPS and Sumirizer TP-D.

Phosophite type antioxidant: Mark 2112, Mark PEP-8, Mark PEP-24G, Mark PEP-36, Mark 329K and Mark HP-10.

The hindered phenol and hindered amine anti-oxidants are preferably employed among these. The anti-oxidant is used in an amount of from 0.1 to 10 weight % with reference to the amount of solid component of the resin layer.

The interlayer is described.

Interlayer

An interlayer comprising inorganic particles is provided between the electro-conductive support and the photoreceptor. The interlayer is used in combination with the charge transfer layer containing mixed compounds represented by formula (1) in specific ratio, whereby recurring image defects such as the speckle and the black spotting caused by the contamination on the photoreceptor surface and the damage such as cracking of the photoreceptor surface are prevented and a clear electrophotographic image of high optical density and high resolution is continuously obtained.

Examples of the inorganic particles used in the interlayer are inorganic oxide. Practical examples include inorganic oxide particle of cerium oxide chromium oxide, aluminum oxide, magnesium oxide, silicon oxide, tin oxide, zirconium oxide, iron oxide, zinc oxide and titanium oxide. Preferable examples are titanium oxide ($TiO_2$), zinc oxide (ZnO), aluminum oxide ($Al_2O_3$) and zirconium oxide ($ZrO_2$) among them, and titanium oxide is used preferably in particular.

The inorganic particles preferably have an number average primary particle diameter of 5–400 nm, and particularly 10–200 nm. The number average of the diameter of the primary particles is determined as the number average of the FERE direction obtained by image analysis of image of randomly selected 100 primary particles employing a transmission electron microscope at a magnification of 10,000.

Crystal type of titanium oxide includes anatase type, rutile type, brookite and amorphous type. Tee anatase type titanium oxide is most preferably used.

It is preferable that the inorganic particle is used after a hydrophobilizing surface treatment. The reactive group on the surface of the particles is preferably made hydrophobic by reacting with a coupling agent etc. It is preferred that, the coupling agent includes silane coupling agent, titanium coupling agent and aluminum coupling agent.

Examples of titanium coupling agent are listed: isopropyltriisostearoyl titanate, isopropyltris(dioctylpyrophosphate)titanate, isopropyltri(N-aminoethyl-aminoethyl)titanate, tetraoctylbis(ditridecylphosphite)titanate, tetra(2,2-diarllyloxymethyl-1-butyl)bis(ditridecyl)phosphite titanate, bis(dioctylpyrophosphate)oxyacetate titanate, bis(dioctylpyrophosphate)ethylene titanate, isopropyltrioctanoyl titanate, isopropyldimethacrylisostearoyldiacrylate titanate, isopropyltridodecylbenzenesulphonyl titanate, isopropylisostearoyldiacryl titanate, isopropyltri(dioctylphosphate)titanate, isopropyltriacylphenyl titanate, and tetraisoproplylbis(dioctylphosphate)titanate.

Example of aluminum coupling agent is acetoalkoxyaluminumdiisopropylate.

Example of silane coupling agent are listed:

Vinyltrichlorosilane, vinyltris(β-methoxyethoxy)silane, vinyltriethoxysilane, vinyltrimethoxysilane, γ-methacryloxypropyl trimethoxysilane, β-(3,4-epoxycyclohexyl)ethyltrimethoxysilane, γ-glycidoxypropyltrimethoxysilane, γ-glycidoxypropylmethyldiethoxysilane, N-β-(aminoethyl)γ-aminopropyltrimethoxysilane, N-β-(aminoethyl)γ-aminopropylmethyldimethoxysilane, γ-aminopropyltriethoxysilane, N-phenyl-γ-aminopropylmethoxysilane, γ-mercaptopropyltrimethoxysilane, γ-chloropropyltrimethoxysilane.

It is preferable that the titanium oxide is subjected to surface treatment before hydrophobilizing treatment (primary treatment) with at least one selected from alumina, silica and zirconia.

The surface treatment with alumina, silica and zirconia is a treatment to deposit alumina, silica and zirconia or their hydrate at a surface of titanium oxide.

It is preferable that at least two treatments are performed including the primary treatment mentioned above and at least one of subsequent treatment in which reactive group after the primary treatment is treated with the coupling agent, whereby uniform surface treatment of the titanium oxide is performed. The titanium oxide treated twice is good in dispersing characteristics and excellent photoreceptor causing minimized image deficiency such as speckles is obtained by employing it.

It is preferred that the treatment with alumina precedes the treatment with silica, though both treatments are performed simultaneously. Treating amount of silica is preferably more than that of alumina when they are treated individually.

Surface treatment of metal oxide such as titanium oxide with alumina, silica and zirconia is may be performed in the following wet method. Titanium oxide particles having an average particle diameter of 50 nm is dispersed in a concentration of 50–350 g/L to make an aqueous slurry, to which water soluble silicate or water soluble aluminum compound is added. Alkali or acid is added to neutralize, and silica or alumina is deposited to the surface of the titanium oxide particles. The targeted surface treated titanium oxide particles are obtained by filtration, washing and drying. Neutralization may be performed by employing acid such as sulfuric acid, nitric acid and hydrochloric acid when sodium silicate is employed for the water soluble silicate. Neutralization may be performed by employing alkali such as sodium hydroxide and potassium hydroxide.

The metal oxide is employed in an amount of 0.1–50 weight %, more preferably 1–10 weight % of titanium oxide for the surface treatment.

Examples of a binder resin used for dispersing the inorganic particles in the interlayer include polyamide resin, vinylchloride resin, vinylacetate resin and a copolymer comprising two or more recurring units of these resins. Polyamide resin is most preferably employed among them to minimize increasing of residual potential at repeated use. The preferable polyamide having the following recurring unit is preferably employed.

Formula (9)

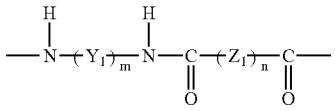

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable since such the polyamide resins display considerable improving effect on the black spot occurrence.

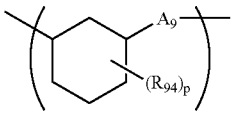

In the above, $A_9$ is a simple bond or an alkylene group having from 1 to 4 carbon atoms; $R_{94}$ is an alkyl group; and p is a natural number of from 1 to 5. Plural $R_{94}$ may be the same as or different from each other.

Concrete examples of the polyamide resin are shown below.

N-1

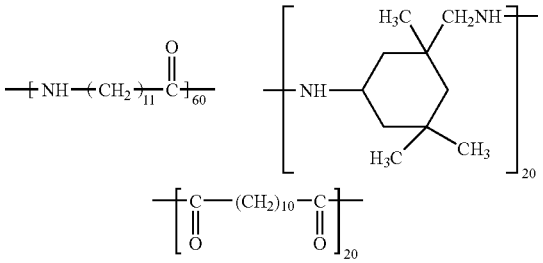

(100%)

-continued

N-2

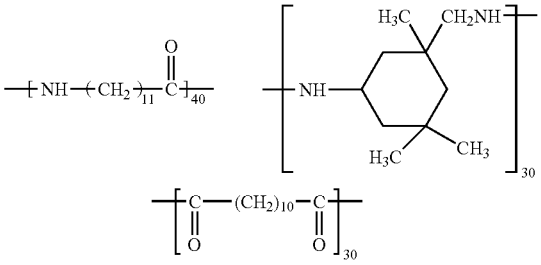

(100%)

N-3

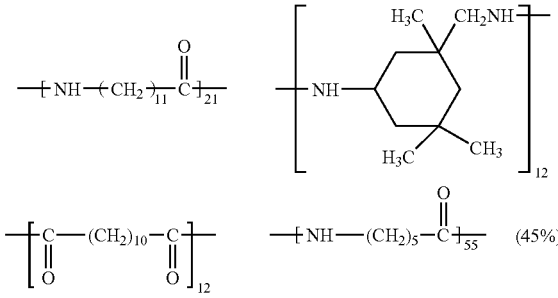

(45%)

N-4

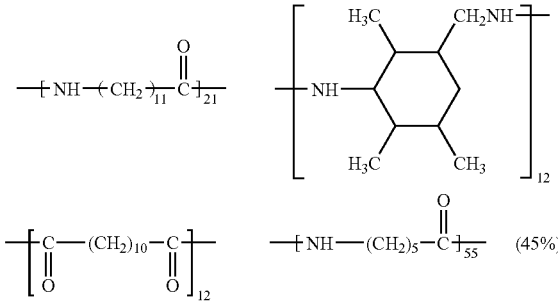

(45%)

N-5

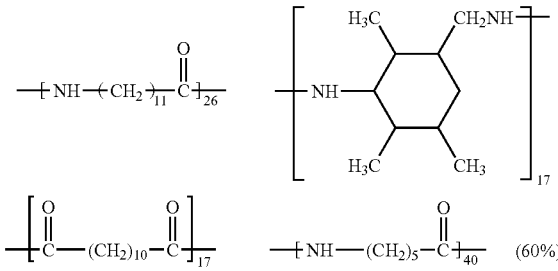

(60%)

N-6

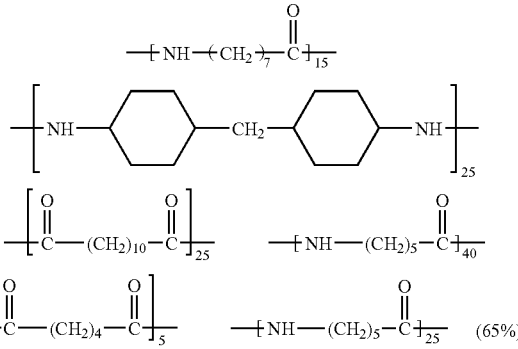

(65%)

-continued

N-7

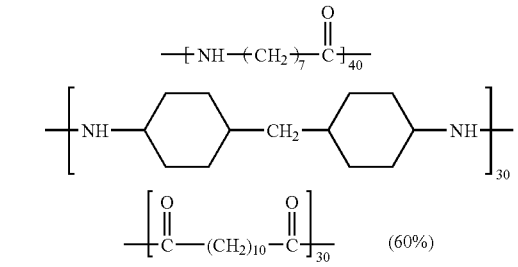

N-8

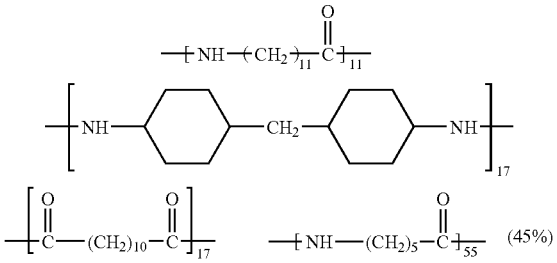

N-9

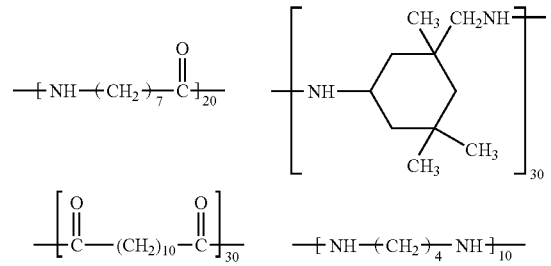

N-10

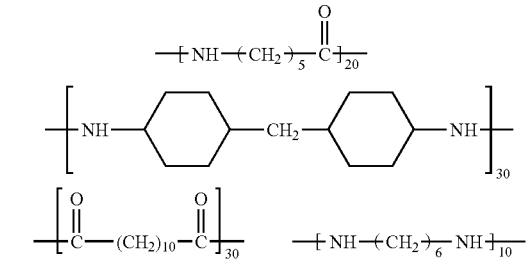

N-11

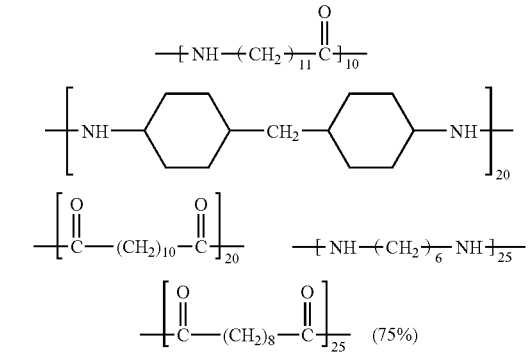

-continued

N-12

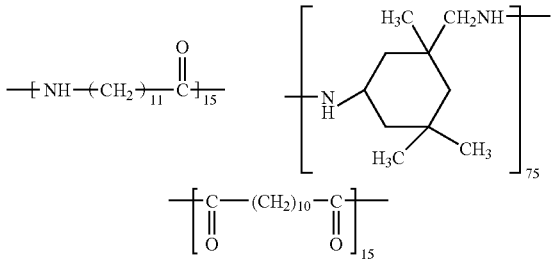

N-13

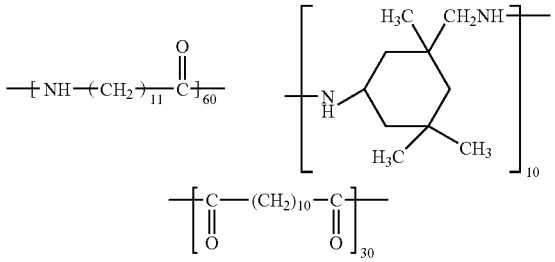

Among the above examples, the polyamide resins of N-1 through N-5, N-9, N-12 and N-13 having the repeating unit represented by Formula 9 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

As the polyamide resin, for example, BESTAMELT X1010 and X4685, manufactured by Daicel•Degusa Co., Ltd., available in the market are usable.

Content of the inorganic particles in the interlayer is preferably 10–70% by weight based on the total amount of solid parts in the interlayer, because charge injection from the electro-conductive support is blocked sufficiently and the inorganic particles are dispersed sufficiently in the interlayer, whereby preferable electrophotographic characteristics such as residual potential and charge potential is obtained.

The interlayer containing the inorganic particles preferably has thickness of 0.1–20.0 μm, and more preferably 0.3–10.0 μm.

The photoreceptor of this invention is further described.

The organic photoreceptor to be used in the invention is described below.

Electroconductive Substrate

Both a sheet-shaped substrate and a cylindrical substrate may be used as the electroconductive substrate of the photoreceptor. The cylindrical electroconductive substrate is preferred for actuating a compact image forming apparatus.

The cylindrical electroconductive substrate is a cylinder-shaped substrate capable of endlessly forming an image, and such the substrate preferably has a linearity of not more than 0.1 mm and a fluctuation of not more than 0.1 mm.

A metal drum made from a metal such as aluminum and nickel, a plastic drum on which a conductive substance such as aluminum, tin oxide and indium oxide is evaporated and a paper or plastic drum on which a electroconductive material is coated, may be used as the electroconductive drum. The electroconductive substrate having a specific conductivity of not less than $10^3$ Ωcm is preferred.

An electroconductive substrate on which an anodized and sealed layer is provided may also be used. The anodizing treatment is usually performed in an acidic bath such as chromic acid, sulfuric acid, oxalic acid, phosphoric acid, boric acid and sulfamic acid, and the treatment by the sulfuric acid bath is preferable. In the case of the anodizing in the sulfuric acid bath, a sulfuric acid concentration of from 100 to 200 g/L, an aluminum ion concentration of from 1 to 10 g/L, a bath temperature of about 20° C. and an applying voltage of about 20 V are preferred. The average thickness of the anodized layer is usually not more than 20 μm, and preferably not more than 10 μm.

Interlayer

The inter layer mentioned above is employed.

Photosensitive Layer

The photoreceptor may be a single layer photoreceptor in which a layer having both functions of charge generation and charge transfer is provided on an interlayer. However, it is preferable that the function of the photosensitive layer is separated into a charge generation layer CGL and a charge transfer layer CTL. By such a separation, the increase of the residual potential accompanying repeated use can be controlled to low levels and other electrophotographic properties can also be easily controlled depending on the purpose. In a photoreceptor to be negatively charged, it is preferred that the CGL is provided on the interlayer and the CTL is provided on the CGL. In a photoreceptor to be positively charged, the CTL is provided on the interlayer and the CGL is provided on the CTL. In the invention, the negatively charged photoreceptor having a function separated structure is most preferable.

The layer arrangement of the function separated type negatively charged photoreceptor is described below.

CGL

CGL contains a charge generation material, CGM. A binder resin and another additive may be incorporated based on the desired function.

Examples of the CGM include a phthalocyanine dye, an azo dye, a perylene dye and an azulenium dye. Of these a CGM having a crystal structure capable of assuming a stable aggregated structure among plural molecules thereof is most effective to inhibit an increase of residual potential accompanying repeated use. Specifically, CGM of a phthalocyanine dye and perylene dye each having a specific crystal structure are exemplified. For example, CGM of titanylphthalocyanine having a maximum peak of Bragg angle 2θ of diffraction of Cu-Kα X-ray at 27.2°, and benzimidazole-perylene having a maximum peak of the 2θ angle at 12.4° show almost no degradation accompanying repeated use and make the residual potential to small.

A resin can be used as the dispersing medium of the CGL or the CTL. Examples of preferable resins include a formal resin, a butyral resin, a silicone resin, a silicone-modified butyral resin and a phenoxy resin. By the use of such the resins, the increase of residual potential accompanying repeated use can be most inhibited. The ratio of the charge generation material to the binder resin is preferably from 20 to 600 parts by weight per 100 parts by weight of the binder resin. The thickness of the charge generation layer is preferably from 0.01 to 2 μm.

CTL

CTL contains the charge transfer material CTM and a binder resin for dispersing the CTM and for forming layer. An additive such as an antioxidant may be contained according to necessity.

As the CTM, a mixture of two or more kinds of compounds each represented by Formula (1) may be used, each of which has the average molecular weight of not more than 2,500, and different from each other in the n value of Formula (1). In addition, for example, a triphenylamine derivative, a hydrazone compound, a styryl compound, a benzidine compound and a butadiene compound may be used together. The charge transfer material is usually dissolved in a suitable resin for forming the layer.

Examples of resin to be used for CTL include a polystyrene resin, an acryl resin, a methacryl resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin and a copolymer containing two or more repeating units of the above-listed resins. Other than the forgoing insulation resin, an organic semi-conductive material such as poly-N-vinylcarbazole is also usable.

Of these, polycarbonate resin is most preferable as the binder from the viewpoint of the dispersibility of the CTM and electrophotographic properties. The ratio of the charge transfer material to the binder is preferably from 10 to 200 parts by weight per 100 parts by weight of the binder resin.

It is preferable that the CTL contains an antioxidant. The antioxidant prevents or inhibits the action caused by lighting, heating or discharging to an auto-oxidization substance being at interior or surface of the photoreceptor.

The charge transfer layer may be constituted by two or more layers. In such case, the surface charge transfer layer satisfies the requirements of the invention. The thickness of the charge transfer layer is preferably from 10 to 40 μm.

Preferable embodiment of the layer arrangement is described above. The other layer arrangement may be available, for example, a protective layer may be provided on the surface of the charge transfer layer.

Examples of the solvent or the dispersing medium for forming the photosensitive layer, interlayer and surface layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2 dichloropropane, 1,1,2-trichloroethnae, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide and methyl cellosolve. Dichloromethane, 1,2-dichloroethane and methyl ethyl ketone are preferably used even though the invention is not limited to the above-mentioned. These solvents may be used solely or as a mixture of two or more kinds thereof.

The coating liquids for the layers are preferably filtered with such as a metal filter or a membrane filter before the coating thereof to remove foreign matters or an aggregate. It is preferable that the filter is selected from filters such as a pleated type filter (HDC), a depth type filter (Profile), each manufactured by Nihon Paul Co., Ltd. and a semi-depth type filter (PROFILSTAR) based on the properties of the coating liquid.

A coating method such as an immersion coating method, a spray coating method or a circular coating amount controlling type coating method is usable for producing the organic electrophotographic photoreceptor. The spray coating method or the coating method using a circular coating amount controlling coating type coater, being typically a circular slide hopper coater, is preferably applied for coating the upper layer of the photosensitive layer since dissolving of the lower layer can be inhibited to remain as small as possible and a uniform coated layer can be formed by such a coating method. The circular coating amount controlling type coater is preferably applied for the coating of the protective layer. The circular coating amount controlling coater is described in, for example, JP O.P.I. Publication No. 58-189061.

The image forming method and the image forming apparatus using the photoreceptor according to the invention are described below.

FIG. 1 shows a cross section of the structure of an image forming apparatus as an example of the image forming method according to the invention.

In FIG. 1, numeral 50 is a photoreceptor drum as an image carrier which is a photoreceptor comprising a drum and an organic photosensitive layer coated on the drum; the drum is grounded and driven to be clockwise rotated. 52 is a scorotron charging device as a charging unit which provides uniform charge onto the circumferential surface of the photoreceptor drum 50 by corona discharge. The residual charge on the drum surface may be removed before charging by charging device 52 by using pre-exposing device 51 having a light emission diode for erasing the charge history.

After uniformly charging the photoreceptor, image exposure based on the image information is provided by image exposure device 53 as an image exposing means. The light source of the exposing device 53 is a laser diode which is not shown in the drawing. A latent static image is formed by scanning via light beam along the optical path introduced by reflection mirror 532 through rotating polygon mirror 531 and an fθ lens.

The reversal developing process is a developing process in which the photoreceptor surface is uniformly charged by charging device 52 and the potential of the image exposed area or the exposed area potential is visualized by a developing unit. Alternatively, the unexposed area is not visualized by the bias potential applied to developing sleeve 541.

Then the latent static image is developed by a developing device 54 as a developing unit. Developing device 54 including a developer comprising a toner and a carrier is arranged around photoreceptor drum 54, and the development is performed by developing sleeve 541 incorporating a magnet and rotated while holding the developer. The interior of the developing device 54 is constituted by a developer stirring and conveying member 544 and 543 and a conveying developer amount regulation member 542, whereby the developer is stirred, conveyed and supplied to the developing sleeve. The supplied amount of the developer is regulated by conveying amount regulating member 542. The conveyed amount of the developer is usually from 20 to 200 $mg/cm^2$ even though the amount may vary depending on the line speed of the electrophotographic photoreceptor and the specific gravity of the developer.

The developer is composed of the carrier, the toner and the external additive. The carrier is composed of a ferrite core coated with an insulation resin, and the toner is composed of a colored particle comprising the styrene-acryl resin as the principal component, the charge controlling agent and low molecular weight polyolefin. Examples of the external additive include silica and titanium oxide. The developer is conveyed into the developing zone while the layer thickness thereof is regulated by the conveying toner amount regulating member, and the development is performed. At this time, the development is usually performed while applying direct current bias, and alternative current bias based on necessity, between the photoreceptor drum and developing sleeve 541. Development is performed in the status in which the developer is contact or not in contact with the photoreceptor. The electrical potential of the photoreceptor is measured by a potential sensor installed at the upper portion of the developing zone.

Recording paper P is synchronously supplied into the transfer zone by the rotation of a paper supplying roller 57 in timing of transfer after the image formation.

In the transfer zone, transfer electrode 58 synchronously acts on the circumference of the photoreceptor drum in time with the transfer to apply charge having the reversed polarity of the toner to recording paper P to which the toner transfers.

The charge of recording paper P is neutralized by a separation electrode or separating device 59, and the recording paper P is separated from the circumference of the photoreceptor drum 59 after which it is conveyed into fixing device 60. In the fixing device the toner is fused and fixed onto the paper by heating and pressing by a heating roller 601 and a pressing roller 602 and ejected out from the apparatus through ejecting roller 61. Transfer electrode 58 and separation electrode 59 are temporarily stopped after passing of recording paper P for preparing to the subsequent image formation. In FIG. 1, a scorotron transfer electrode is used. Conditions of the transfer electrode are set at, for example, a transfer current of from +100 to +400 μA and a transfer voltage of from +500 to +2,000 V even though the conditions cannot be simply limited since the conditions vary depending on the processing speed or circumferential rate of the photoreceptor.

Toner remaining on photoreceptor drum 50 after the separation of recording paper P is removed, and the drum surface is cleaned by cleaning blade 621 or brush 622 of a cleaning device or cleaning unit 62 pressed onto the drum, which is then subjected to exposure before charging by pre-exposing device 51 and to charging by charging device 52. Thus photoreceptor drum 50 enters the next image forming cycle.

Numeral 70 is a processing cartridge capable of being freely installed in and released from the apparatus, in which the photoreceptor, the charging device, the transferring device, the separation device and the cleaning device are integrated.

The electrophotographic photoreceptor according to the invention is suitable for an electrophotographic photoreceptor, a laser printer, an LED printer and a liquid crystal shutter type printer. Further, the photoreceptor can be widely applied to an apparatus utilizing electrophotographic technology for display, recording, light printing, plate making and facsimile.

EXAMPLES

The present invention is described in detail referring to the examples below. In the following, "part" means "parts by weight".

Example 1

Photoreceptors containing a mixture of compounds represented by Formula (A) were prepared as follow.

Preparation of Photoreceptor 1A

| <Interlayer> | |
|---|---|
| Polyamide resin, Compound N-1 | 60 parts |
| Inorganic fine particles, titanium oxide, surface treated by silica, alumina, and methyl hydrogen polysiloxane, having number average primary particle diameter of 35 nm) | 180 parts |
| t-propanol | 1600 parts |
| 1-butanol | 400 parts |

The above components were mixed and dissolved to prepare an interlayer coating liquid. The coating liquid was coated by an immersion method on the cylindrical aluminum substrate and dried. Thus a 1.0 μm interlayer was formed.

| <Charge generation layer> | |
|---|---|
| Titanylphthalocyanine (The highest peak of Bragg angle 2θ of 27.3° for Cu-Kα characteristic X-ray diffraction) | 60 parts |
| Silicone resin solution, 15% xylene/butanol solution of KR5240 (Shin-Etsu Chemical Co., Ltd.) | 700 parts |
| 2-butanone | 2000 parts |

The above components were mixed and dispersed for 10 hours using a sand mill to prepare a charge generation layer coating liquid. The coating liquid was coated onto the interlayer by the immersion method and dried. Thus a 0.3 μm charge generation layer was formed.

| <Charge transfer layer> | |
|---|---|
| Charge transfer material (Compound of Synthesizing Example 1) | 150 parts |
| Binder resin, bis-phenol Z type polycarbonate Iupilon Z300 (Mitsubishi Gas Chemical Company Inc.) | 300 parts |
| Antioxidant, SANOL LS2626 (Sankyo Co., Ltd.) | 1.7 parts |
| Tetrahydrofuran | 2000 parts |

The above components were mixed and dissolved to prepare a charge transfer layer coating liquid. The coating liquid was applied onto the charge generation layer by the immersion method and dried for 60 minutes at 110° C. to form a 19 μm charge transfer layer, whereby Photoreceptor 1A was prepared.

Preparation of Photoreceptors of 2A through 14A

Photoreceptors 2 through 14A were prepared in the same manner as Photoreceptor 1A except that the charge generation compound, the charge transfer compound, the amounts of the compounds, and the thickness of the charge transfer layer were altered as shown in Table 1. The interlayers B through J were prepared by employing organic particles and binder shown in Table 2.

Preparation of Photoreceptor 15A

Photoreceptor 15A was prepared in the same manner as Photoreceptor 1A except that the charge transfer material or the compound of Synthesizing Example 1 was replaced by the component n=0 of Compound 21A (p=0, q=0) synthesized by a commonly known method. The purity of the component was greater than 99%.

Preparation of Photoreceptor 16A

Photoreceptor 16A was prepared in the same manner as Photoreceptor 1A except that the charge transfer material or the compound of Synthesizing Example 1 was replaced by the n=3 component of Compound 21A (p=0, q=0) separated by liquid chromatography from the compound of Synthesizing Example 1. The purity of the component was larger than 99%. However, any photoreceptor capable of being evaluated cannot be obtained since the compound was not permissible with the binder resin and precipitated.

Preparation of Photoreceptor 17A

The compound of Synthesizing Example 1 was separated by liquid chromatography into each component and a mixture of 50% of the n=1 component and 50% of n=2 of Compound 21A (p=0, q=0) was prepared. Then Photoreceptor 17A was prepared in the same manner as Photoreceptor 1A except that the charge transfer material was replaced by the above mixture.

Preparation of Photoreceptor 18A

Photoreceptor 18A was prepared in the same manner as Photoreceptor 1A except that inorganic particle was not employed in the inter layer.

TABLE 1

| | | CTL | | | | | | | | | | | | | | | | | |
|---|---|---|---|---|---|---|---|---|---|---|---|---|---|---|---|---|---|---|---|
| | | CTM (Compound and component ratio) | | | | | | | | | | | | | | | | | |
| (*1) No. | CGL CGM | Compound No. | p | q | n = 0 | n = 1 | n = 2 | n = 3 | n = 4 | n = 5 | n = 6 | n = 7 | n = 8 | (Rp + Rs) | (*2) | (*3) | (*4) (μm) | Inter layer |
| 1A | Y | 21A | 0 | 0 | 27.4 | 44.8 | 20.1 | 6.3 | 1.4 | 0.0 | 0.0 | 0.0 | 0.0 | 72.2 | 1475 | 150 | 19 | A |
| 2A | Y | 21A | 1 | 0 | 33.4 | 46.8 | 15.0 | 4.0 | 0.8 | 0.0 | 0.0 | 0.0 | 0.0 | 80.2 | 1314 | 150 | 19 | B |
| 3A | Y | 14A | 1 | 0 | 30.1 | 45.4 | 16.7 | 6.0 | 1.8 | 0.0 | 0.0 | 0.0 | 0.0 | 75.5 | 1194 | 150 | 19 | C |
| 4A | Y | 21A | 0 | 0 | 27.4 | 44.8 | 20.1 | 6.3 | 1.4 | 0.0 | 0.0 | 0.0 | 0.0 | 72.2 | 1475 | 225 | 24 | D |
| 5A | Y | 21A | 0 | 0 | 27.4 | 44.8 | 20.1 | 6.3 | 1.4 | 0.0 | 0.0 | 0.0 | 0.0 | 72.2 | 1475 | 100 | 13 | E |
| 6A | Y | 12A | 0 | 0 | 54.0 | 31.3 | 10.3 | 3.5 | 0.9 | 0.0 | 0.0 | 0.0 | 0.0 | 85.3 | 991 | 150 | 19 | F |
| 7A | Y | 16A | 0 | 0 | 31.5 | 46.0 | 16.0 | 5.3 | 1.2 | 0.0 | 0.0 | 0.0 | 0.0 | 77.5 | 1426 | 150 | 19 | G |
| 8A | Z | 22A | 0 | 0 | 21.1 | 43.8 | 22.0 | 9.8 | 3.0 | 0.3 | 0.0 | 0.0 | 0.0 | 65.8 | 1663 | 150 | 19 | H |
| 9A | Z | 36A | 0 | 0 | 33.7 | 34.0 | 19.8 | 9.6 | 2.7 | 0.2 | 0.0 | 0.0 | 0.0 | 67.7 | 1739 | 150 | 19 | I |
| 10A | Y | 15A | 0 | 1 | 29.6 | 41.1 | 20.5 | 7.6 | 1.2 | 0.0 | 0.0 | 0.0 | 0.0 | 70.7 | 1520 | 150 | 19 | A |
| 11A | Y | 12A | 1 | 1 | 19.8 | 36.1 | 28.6 | 10.4 | 4.1 | 1.0 | 0.0 | 0.0 | 0.0 | 64.7 | 1892 | 150 | 19 | B |
| 12A | Y | 21A | 0 | 0 | 5.8 | 13.0 | 21.0 | 22.2 | 17.5 | 11.1 | 6.1 | 3.0 | 0.3 | 43.2 | 2282 | 150 | 19 | C |
| 13A | Y | 21A | 0 | 0 | 12.7 | 25.9 | 30.3 | 18.1 | 9.2 | 2.9 | 0.9 | 0.0 | 0.0 | 56.2 | 1869 | 150 | 19 | D |
| 14A | Y | 21A | 0 | 0 | 65.4 | 28.9 | 5.2 | 0.5 | 0.0 | 0.0 | 0.0 | 0.0 | 0.0 | 94.3 | 908 | 150 | 19 | E |

TABLE 1-continued

| | | CTL | | | | | | | | | | | | | | | | |
|---|---|---|---|---|---|---|---|---|---|---|---|---|---|---|---|---|---|---|
| | | CTM (Compound and component ratio) | | | | | | | | | | | | | | | | |
| (*1) No. | CGL CGM | Compound No. | p | q | n = 0 | n = 1 | n = 2 | n = 3 | n = 4 | n = 5 | n = 6 | n = 7 | n = 8 | (Rp + Rs) | (*2) | (*3) | (*4) (μm) | Inter layer |
| 15A | Y | 21A | 0 | 0 | 100 | 0.0 | 0.0 | 0.0 | 0.0 | 0.0 | 0.0 | 0.0 | 0.0 | 100 | 643 | 150 | 19 | A |
| 16A | Y | 21A | 0 | 0 | 0.0 | 0.0 | 0.0 | 100 | 0.0 | 0.0 | 0.0 | 0.0 | 0.0 | 100 | 1882 | 150 | 19 | A |
| 17A | Y | 21A | 0 | 0 | 0.0 | 50 | 50 | 0.0 | 0.0 | 0.0 | 0.0 | 0.0 | 0.0 | 100 | 1263 | 150 | 19 | A |
| 18A | Y | 21A | 0 | 0 | 27.4 | 44.8 | 20.1 | 6.3 | 1.4 | 0.0 | 0.0 | 0.0 | 0.0 | 72.2 | 1475 | 150 | 19 | J |

(*1) Photoreceptor
(*2) Average molecular weight (Mw)
(*3) Content (parts)
(*4) Thickness In the above table, Y is titanylphthalocyanine pigment (in which the highest peak of a Bragg angle 2θ is 27.3° of a Cu-Kα characteristic X-ray diffraction spectrogram).

Z is benzimidazole perylene pigment (the highest peak of a Bragg angle 2θ is 12.4° of a Cu-Kα characteristic X-ray diffraction spectrogram).

(Rp+Rs) is the sum of the content in percent of the compound having the maximum content in the mixture and the content in percent of the compound having the content next to the maximum content.

The distribution or content ratio of n of the chain structure of the charge transfer material is determined based on the ratio of the area of high speed liquid chromatograph GPC. The average molecular weight, Mw, is the weight average molecular weight in terms of polystyrene determined via gel permeation chromatography.

TABLE 2

| | Inorganic particles | | | | | |
|---|---|---|---|---|---|---|
| Interlayer | Inorganic particles | dn (nm) | Primary treatment | Second treatment | Added Amount (Parts) | Binder (Polyamide) |
| A | $TiO_2$ | 35 | Silica/Alumina | Methyl hydrogen siloxane | 180 | N-1 |
| B | $TiO_2$ | 35 | Silica/Alumina | Methyl hydrogen siloxane | 100 | N-1 |
| C | $TiO_2$ | 13 | Silica/Alumina | Methyl hydrogen siloxane | 10 | N-1 |
| D | $TiO_2$ | 35 | Silica/Alumina | Methyl disilazane | 20 | N-1 |
| E | $TiO_2$ | 85 | Silica/Alumina | Methyl disilazane | 20 | N-3 |
| F | $TiO_2$ | 120 | Silica/Alumina | Octyl silane | 20 | N-3 |
| G | $Al_2O_3$ | 170 | — | Methyl disilazane | 10 | N-5 |
| H | ZnO | 200 | — | Methyl disilazane | 30 | N-5 |
| I | $TiO_2$ | 85 | Silica/Alumina | Methyl disilazane | 45 | N-5 |
| J | — | — | — | — | — | N-1 |

Evaluation

The above-obtained Photoreceptors 1A through 18A were each installed into a digital copying machine utilizing reversal development system Konica 7085, manufactured by Konica Corp., and subjected to the following evaluation. The copying machine had a scorotron charging device, a semi-conductor laser exposing device emitting 680 nm light, a reversal developing unit and a printing rate of 85 sheets of A4 size paper per minute. Evaluation was carried out under an environmental conditions, or temperature and moisture conditions based on each of the evaluation items. The evaluation was basically performed on 10,000 copied sheets by an intermittent mode. Used an original image for the copying test was a A4 size image including a texture image at a pixel ratio of 7%, a halftone image, a solid white image and a solid black image each occupying one fourth of the original image area. Results of the evaluation are shown in Table 3.

Evaluation Condition

Line speed: 420 mm/second

Duration between the imagewise exposure and the developing position: 0.108 second Charging Condition Charging device: Scorotron charging device for negative charging Charging potential: −700 V to −750 V Exposure Condition Exposure amount was set so that the potential of the solid black image portion was −100 V.

Exposing beam: Semi-conductor laser of 680 nm

Developing Condition

A developer composed of a ferrite carrier coated with an insulation resin and a toner composed of a colored particles and silica and titanium oxide added as the external additive was used. The colored particle had a volume average diameter of 5.3 μm and contained a styrene-acryl resin as the principal component, carbon black as the colorant, a charge controlling agent and a low molecular weight polyolefin. The colored particles were prepared via a polymerization method.

Transferring Condition

Transferring electrode: Corona charging electrode for positive charging

Separation Condition

A separating unit of a separation claw unit was used.

Cleaning Condition

A cleaning blade having a hardness of 70°, a repulsive elasticity of 65%, a thickness of 2 mm and a free length of 9 mm was placed onto the photoreceptor in the counter clockwise direction and a line pressure of 18 g/cm was applied by a weight loading system.

Evaluation Items and Methods

Evaluation was carried out at high speed response or electrical potential variation of the solid black image area under a low temperature and low humidity condition of 10° C. and 20% RH.

Copying of 10,000 sheets by an intermittent mode was performed under the above low temperature-humidity condition. Used as the original image for the copying test was a A4 size image including text at a pixel ratio of 7%, a halftone image, a solid white image and a solid black image each occupying one fourth of the original image area. The difference of the electrical potential at initiation of printing and that after 10,000 sheets of copying of the solid black image area $|\Delta V|$ was measured. A smaller value of $|\Delta V|$ corresponds to a higher high-speed response under the low temperature and low moisture condition of 10° C. and 20% RH, respectively.

A: The electrical potential variation of the solid black image area $|\Delta V|$ was less than 50V; rated as good.

B: The potential variation at the solid black image area $|\Delta V|$ is from 50 V to 150 V; rated as no problem for practical use.

C: The potential variation at the solid black image area $|\Delta V|$ was more than 150V; rated as potential problems in the practical use.

Thinning of texture image under low temperature and low humidity condition of 10° C. and 20% RH.

An original image on which line at a width of 0.1 mm and 0.2 mm was copied for evaluation.

A: In the copied image, the width of reproduced line was not less than 75% of the original image; rated as good.

B: In the copy image, the width of reproduced line was from 40% to 74% of the original image; rated as no problem for the practical use.

C: In the copy image, the width of reproduced line was not more than 39% of that of the original image or the line image was broken; rated as a potential problem in practical use.

Speckle under a high temperature and high humidity condition of 30° C. and 80% RH The occurrence of the speckle (strawberry seed like shaped spotted image) on the halftone image was evaluated according to the following norms.

A: No speckle forming nucleus was observed on the photoreceptor and no speckle observed on the halftone image; rated as good.

B: No speckle occurred on the halftone image even though speckle forming nuclei observed on the photoreceptor; rated as no problem for practical use.

C: Speckle forming nuclei were observed on the photoreceptor and speckle occurred on the halftone image; rated as a potential problem in practical use.

Occurrence of recurring image defects under a high temperature and high humidity condition of 30° C. and 80% RH Evaluated was number of visible recurring defect such as a white image lacking, speckle and line-shaped defects wherein synchronous with the period of rotation of the photoreceptor.

A: Frequency of image defects of not less than 0.4 mm was not more than 5 per A4 size image in the entire copies; rated as good.

B: Frequency of the image defect of not less than 0.4 mm was that at least one sheet having 6 to 10 defects per A4 size image was found; rated as no problem for practical use.

C: Frequency of the image defect of not less than 0.4 mm was that at least one sheet having not less than 11 defects per A4 size image was found; rated as a potential problem in practical use.

Cracking

The power source was turned to the digital copying machine Konica 7085 in which the photoreceptors to be evaluated were installed, and stood idle for 2 days under a condition of 30° C. and 80% RH. During the idling for 2 days, the devices around the photoreceptor were stayed at the condition when the action was stopped, namely the cleaning blade and the developer conveying member remained in the contacted state to the photoreceptor. Thereafter, the occurrence of the cracking on the surface of the photoreceptor was observed, in addition, the occurrence of linear image defects accompanying the occurrence of cracking was also evaluated.

A: One hundred photoreceptors were evaluated but no cracking nor image defect were found; rated as good.

B: One hundred photoreceptors were evaluated and slight cracking was found but no image defect was observed; rated as no problem for practical use.

C: One hundred photoreceptors were evaluated and cracking and the line-shaped image defects were observed; rated as potential a problem in practical use.

Image density under the low temperature and low humidity condition of 10° C. and 20% RH The reflective density of a solid black image was measured via RD-918, manufactured by Macbeth Co., Ltd. The evaluation was performed according to the relative density when the density of an A4 size paper sheet before copying was set at 0.00.

A: Not less than 1.2; rated as good.

B: Not less than 1.2 to 0.8; rated as no problem for practical use.

C: Less than 0.8; rated as a potential problem in practical use.

Sharpness

Images of 3 and 5 point characters formed under low temperature and humidity condition of 10° C. and 20% RH respectively and that formed under a high temperature and humidity condition of 30° C. and 80% RH were evaluated for spreading of the text images according to the following norms.

A: Both of the images of the 3 and 5 point characters were clear and easily read.

B: Part of the images of 3 point character were unreadable but the images of 5 point character were easily read.

C: Almost all of the images of 3 point characters were unreadable and all or parts of the images of 5 point characters were also unreadable.

TABLE 3

| Photoreceptor No. | Potential variation at solid black image area \|ΔV\| | Thinning of Character | Speckle | Recurring Defect | Cracking | Image density | Sharpness |
|---|---|---|---|---|---|---|---|
| 1A | A | A | B | A | A | A | B |
| 2A | A | A | A | A | A | A | A |
| 3A | A | A | A | A | A | A | A |
| 4A | A | A | B | A | A | A | B |
| 5A | A | A | A | A | A | A | A |
| 6A | A | A | A | A | A | A | A |
| 7A | B | B | A | B | B | A | B |
| 8A | B | B | A | B | B | A | B |
| 9A | A | A | A | A | A | A | A |
| 10A | A | A | A | B | B | A | B |
| 11A | A | A | A | A | A | A | A |
| 12A | B | B | A | A | B | B | B |
| 13A | A | A | A | A | A | A | A |
| 14A | A | B | A | B | A | B | B |
| 15A | C | C | C | B | B | C | C |
| 16A | Evaluation impossible | Evaluation impossible | Evaluation impossible | Evaluation impossible | Evaluation impossible | Evaluation impossible | Evaluation impossible |
| 17A | C | B | B | C | C | C | C |
| 18A | C | B | B | C | A | C | C |

As is shown in Table 3, Photoreceptors 1A through 14A using the mixture of compounds as the charge transfer material in which (Rp+Rs) is not more than 99% are excellent in the high speed response, namely the potential variation of the solid black image area is small, under a low temperature and low humidity condition of 10° C. and 20% RH, accordingly thinning of the character image does not occur. In addition, the speckle, the recurring image defects and the cracking are not observed with excellent image density and the sharpness. On the contrary, Photoreceptor 15A using only the low molecular weight compound of n=0 is inferior in the high speed response under the low temperature and low humidity condition and causes the thinning of the character image. In addition, the layer is soft; the speckle and the recurring image defects occur and the image density and the sharpness are also degraded. In the case of Photoreceptor 16A only using the high molecular weight compound of n=3, the compatibility of the compound with the binder resin is poor, and the photoreceptor has little sensitivity. Therefore, such a photoreceptor is not worth evaluation. In Photoreceptor 17A using a mixture of 50% of component n=1 and 50% of component n=2 of Compound 21A (p=0, q=0), solubility of the compound mixture with a binder resin is insufficient. Consequently, the potential variation of the solid black image portion is large and the recurring image defects and the cracking was observed. In addition the image density and the sharpness are also lowered. Photoreceptor 18A, which does not contain inorganic particle, showed high potential variation at black solid imaging portion, periodic image defects are found and showed low image density and sharpness.

Example 2

Photoreceptors containing the mixture of compounds represented by Formula (B) were prepared as follows.

Preparation of Photoreceptor 1B

| <Interlayer> | |
|---|---|
| Polyamide resin, Compound N-1 shown above | 60 parts |
| Inorganic particle: titanium oxide, surface treated by silica, alumina, and methyl hydrogen polysiloxane, having number average primary particle diameter of 35 nm) | 180 parts |
| t-propanol | 1600 parts |
| 1-butanol | 400 parts |

The above components were mixed and dissolved to prepare an interlayer coating liquid. The coating liquid was coated on a cylindrical aluminum substrate by the immersion coating method and dried to form a 3.0 μm interlayer.

| <Charge generation layer> | |
|---|---|
| Titanylphthalocyanine (The highest peak of Bragg angle 2θ at a 27.3° of Cu-Kα characteristic X-ray diffraction) | 60 parts |
| Silicone resin solution, 15% xylene-butanol solution of KR5240 (Shin-Etsu Chemical Co., Ltd.) | 700 parts |
| 2-butanone | 2000 parts |

The above components were mixed and dispersed by a sand mill for 10 hours to prepare a charge generation layer coating liquid. The coating liquid was applied onto the foregoing interlayer by an immersion method and dried. Thus a 0.3 μm charge generation layer was formed.

| <Charge transfer layer> | |
|---|---|
| Charge transfer material, Compound of Synthesizing Example 4 | 150 parts |
| Binder resin, bis-phenol Z type polycarbonate Iupilon Z300 (Mitsubishi Gas Chemical Company Inc.) | 300 parts |

-continued

| <Charge transfer layer> | |
|---|---|
| Antioxidant SANOL LS2626 (Sankyo Co., Ltd.) | 1.7 parts |
| Tetrahydrofuran | 2200 parts |

The above components were mixed and dissolved to prepare a charge transfer layer coating liquid. The coating liquid was applied onto the foregoing charge generation layer by an immersion coating method and dried for 60 minutes at 110° C. Thus a thickness of 19 μm charge transfer layer was formed to prepare Photoreceptor 1B.

Preparation of Photoreceptors 2B through 14B

Photoreceptors 2B through 14B were prepared in the same manner as Photoreceptor 1B except that the compound of charge generation material, the compound of charge transfer material and their amount and thickness of the charge transfer layer were changed as listed in Table 1. The interlayers B through J were prepared by employing organic particles and binder shown in Table 2.

Preparation of Photoreceptor 15B

Photoreceptor 15B was prepared in the same manner as Photoreceptor 1B except that the charge transfer material or the compound of Synthesizing Example 5 was replaced by the component n=0 of Compound 11B (m=0) synthesized by a commonly known method. The purity of the component was greater than 99%.

Preparation of Photoreceptor 16B

Photoreceptor 16B was prepared in the same manner as Photoreceptor 1B except that the charge transfer material or the compound of Synthesizing Example 5 was replaced by the component n=3 of Compound 11B (m=0) separated by liquid chromatography from the compound of Synthesizing Example 5. The purity of the component was larger than 99%. However, any photoreceptor capable of being evaluated could not be obtained since the compound was not compatible with the binder resin and precipitated.

Preparation of Photoreceptor 17B

The compound of Synthesizing Example 5 was separated by liquid chromatography into each component and a mixture of 50% of the n=1 component and 50% of n=2 of Compound 11B (m=0) was prepared. Then Photoreceptor 17B was prepared in the same manner as Photoreceptor 1B except that the charge transfer material was replaced by the above mixture.

Compound 11B (m=0) was separated by liquid chromatography into each component and a mixture of 50% of the component n=2 and 50% of n=3 was prepared.

Preparation of Photoreceptor 18B

Photoreceptor 18B was prepared in the same manner as Photoreceptor 1A except that inorganic particle was not employed in the inter layer.

TABLE 4

| Photo- | | CTL | | | | | | | | | | | | | | | |
|---|---|---|---|---|---|---|---|---|---|---|---|---|---|---|---|---|---|
| | | CTM (Compound and component ratio) | | | | | | | | | | | | | | | |
| Recaptor No. | CGL CGM | Compound No. | m | n = 0 | n = 1 | n = 2 | n = 3 | n = 4 | n = 5 | n = 6 | n = 7 | n = 8 | (Rp + Rs) | (*1) | (*2) | Thickness (μm) | (*3) |
| 1B | Y | 12B | 0 | 24.3 | 44.4 | 21.5 | 7.2 | 2.3 | 0.3 | 0.0 | 0.0 | 0.0 | 68.2 | 1542 | 150 | 19 | A |
| 2B | Y | 11B | 0 | 32.5 | 45.0 | 16.0 | 5.3 | 1.2 | 0.0 | 0.0 | 0.0 | 0.0 | 77.5 | 1297 | 150 | 19 | B |
| 3B | Y | 5B | 0 | 33.7 | 34.6 | 19.4 | 9.6 | 2.7 | 0.0 | 0.0 | 0.0 | 0.0 | 68.3 | 1653 | 150 | 19 | C |
| 4B | Y | 12B | 0 | 24.3 | 44.4 | 21.5 | 7.2 | 2.3 | 0.3 | 0.0 | 0.0 | 0.0 | 68.7 | 1542 | 225 | 24 | D |
| 5B | Y | 12B | 0 | 24.3 | 44.4 | 21.5 | 7.2 | 2.3 | 0.3 | 0.0 | 0.0 | 0.0 | 68.7 | 1542 | 100 | 13 | E |
| 6B | Y | 15B | 0 | 22.1 | 43.8 | 21.0 | 9.8 | 3.0 | 0.3 | 0.0 | 0.0 | 0.0 | 65.9 | 1490 | 150 | 19 | F |
| 7B | Y | 17B | 0 | 52.0 | 31.3 | 12.3 | 3.5 | 0.9 | 0.0 | 0.0 | 0.0 | 0.0 | 83.3 | 975 | 150 | 19 | G |
| 8B | Z | 7B | 1 | 33.9 | 46.3 | 15.0 | 4.0 | 0.8 | 0.3 | 0.0 | 0.0 | 0.0 | 80.2 | 1663 | 150 | 19 | H |
| 9B | Z | 13B | 0 | 25.4 | 40.8 | 18.1 | 6.3 | 1.4 | 0.0 | 0.0 | 0.0 | 0.0 | 76.2 | 1515 | 150 | 19 | I |
| 10B | Y | 22B | 0 | 32.6 | 45.0 | 14.2 | 7.3 | 0.9 | 0.0 | 0.0 | 0.0 | 0.0 | 87.6 | 1784 | 150 | 19 | A |
| 11B | Y | 20B | 1 | 19.8 | 36.1 | 28.6 | 10.4 | 4.1 | 1.0 | 0.0 | 0.0 | 0.0 | 64.7 | 1833 | 150 | 19 | B |
| 12B | Y | 12B | 0 | 72.0 | 19.8 | 6.1 | 2.1 | 0.0 | 0.0 | 0.0 | 0.0 | 0.0 | 91.8 | 865 | 150 | 19 | C |
| 13B | Y | 12B | 0 | 6.8 | 13.5 | 20.3 | 22.5 | 16.2 | 10.2 | 6.3 | 3.8 | 0.4 | 42.8 | 2259 | 150 | 19 | D |
| 14B | Y | 12B | 0 | 15.2 | 24.2 | 31.2 | 18.2 | 8.1 | 2.3 | 0.8 | 0.0 | 0.0 | 55.4 | 1826 | 150 | 19 | E |
| 15B | Y | 11B | 0 | 100 | 0.0 | 0.0 | 0.0 | 0.0 | 0.0 | 0.0 | 0.0 | 0.0 | 100 | 672 | 150 | 19 | A |
| 16B | Y | 11B | 0 | 0.0 | 0.0 | 0.0 | 100 | 0.0 | 0.0 | 0.0 | 0.0 | 0.0 | 100 | 1869 | 150 | 19 | A |
| 17B | Y | 11B | 0 | 0.0 | 0.0 | 50 | 50 | 0.0 | 0.0 | 0.0 | 0.0 | 0.0 | 100 | 1670 | 150 | 19 | A |
| 18B | Y | 12B | 0 | 24.3 | 44.4 | 21.5 | 7.2 | 2.3 | 0.3 | 0.0 | 0.0 | 0.0 | 68.2 | 1542 | 150 | 19 | J |

(*1) Average molecular weight
(*2) Content (parts)
(*3) Interlayer

In the Table 4 Y, Z (Rp+Rs) are the same as those in Table 1.

The distribution or the ratio of the n of the chain structure of the charge transfer material was determined from the area ratio of the high speed liquid chromatography. The average Mw was the weight average molecular weight in terms of polystyrene determined by the gel permeation chromatography.

Evaluation

Thus obtained Photoreceptors 1B through 18B were each installed into the reversal development digital copying machine Konica 7085 having a scorotron charging device, a semi-conductor laser exposing device emitting light at 680 nm and a reversal developing unit, and operated at a copying rate of 85 sheets of a4 size paper per minute, and evaluated in the same manner as Example 1. Results of the evaluation are listed in Table 5.

TABLE 5

| Photoreceptor No. | Potential variation at solid black image area (\|ΔV\|) | Thinning of character image | Speckle | Recurring image defect | Cracking | Image density | Sharpness |
|---|---|---|---|---|---|---|---|
| 1B | A | A | A | A | A | A | A |
| 2B | A | A | A | A | A | A | A |
| 3B | A | A | A | A | A | A | A |
| 4B | A | A | A | A | A | A | A |
| 5B | A | A | A | A | A | A | A |
| 6B | A | A | A | A | A | A | A |
| 7B | A | A | A | A | A | A | A |
| 8B | A | A | A | A | A | A | A |
| 9B | A | A | A | A | A | A | A |
| 10B | A | A | A | A | A | A | A |
| 11B | A | A | A | A | A | A | A |
| 12B | A | B | A | B | A | B | B |
| 13B | B | B | A | A | B | B | B |
| 14B | A | A | A | A | A | A | A |
| 15B | C | C | C | C | B | C | C |
| 16B | *1 | *1 | *1 | *1 | *1 | *1 | *1 |
| 17B | C | B | B | C | C | C | C |

Inv.; Inventive
Comp.; Comparative
*1; Cannot be evaluated.

As is shown in Table 5, Photoreceptors 1B through 14B using the mixture of compounds as the charge transfer material in each of which (Rp+Rs) is not more than 99% are excellent in the high speed response, namely the potential variation of the solid black image area is small, under low temperature and humidity conditions of 10° C. and 20% RH, so that thinning of image characters does not occur. In addition, the speckle, the recurring image defects and the cracking are not formed and excellent in the image density and the sharpness. Contrary, Photoreceptor 15B only using the low molecular weight n=0 compound is inferior in the high speed response under the low temperature and humidity condition and causes the thinning of the character image. In addition, the layer is soft; speckle and recurring image defects occur, and in addition image density and sharpness are also degraded. In the case of Photoreceptor 16B using only the high molecular weight compound n=3, the compatibility of the compound with the binder resin is poor, and the photoreceptor has little sensitivity. Therefore, such a photoreceptor is not worth evaluation. In Photoreceptor 17B using the mixture of 50% of component n=2 and 50% of component n=3 of Compound 11B (m=0), the solubility of the compound mixture with the binder resin is insufficient. Consequently, the potential variation at solid black image area is wide and the recurring image defects and the cracking occur. In addition image density and sharpness are also lowered. Photoreceptor 18B, which does not contain inorganic particle, showed high potential variation at black solid imaging portion, periodic image defects are found and showed low image density and sharpness.

Example 3

Photoreceptors containing the mixture of compounds represented by Formula (C) were prepared as follows.

Preparation of Photoreceptor 1C

| <Interlayer> | |
|---|---|
| Polyamide resin, Compound N-1 shown above | 60 parts |
| Inorganic particle: titanium oxide, surface treated by silica, alumina, and methyl hydrogen polysiloxane, having number average primary particle diameter of 35 nm) | 180 parts |
| t-propanol | 1600 parts |
| 1-butanol | 400 parts |

The above components were mixed and dissolved to prepare an interlayer coating liquid. The coating liquid was coated on a cylindrical aluminum substrate by an immersion coating method and dried to form a 7.0 μm interlayer.

| <Charge generation layer> | |
|---|---|
| Titanylphthalocyanine (The highest peak of a Bragg angle 2θ at 27.3° for Cu-Kα characteristic X-ray diffraction) | 60 parts |
| Silicone resin solution, 15% xylene-butanol solution of KR5240 (Shin-Etsu Chemical Co., Ltd.) | 700 parts |
| 2-butanone | 2000 parts |

The above components were mixed and dispersed by a sand mill for 10 hours to prepare a charge generation layer coating liquid. The coating liquid is coated onto the foregoing interlayer by the immersion method and dried. Thus a 0.3 μm charge generation layer was formed.

| <Charge transfer layer> | |
|---|---|
| Charge transfer material, Compound of Synthesizing Example 6 | 150 parts |
| Binder resin, bis-phenol Z type polycarbonate Iupilon Z 300 (Mitsubishi Gas Chemical Company Inc.) | 300 parts |

-continued

| <Charge transfer layer> | |
|---|---|
| Antioxidant SANOL LS2626 (Sankyo Co., Ltd.) | 1.7 parts |
| Tetrahydrofuran | 2200 parts |

The above components were mixed and dissolved to prepare a charge transfer layer coating liquid. The coating liquid was coated on the foregoing charge generation by the immersion coating method and dried for 60 minutes at 110° C. Thus a charge transfer layer with a thickness of 19 μm was formed to prepare Photoreceptor 1C.

Preparation of Photoreceptor 2C

Photoreceptor 2C was prepared in the same manner as Photoreceptor 1C except that the compound of Synthesizing Example 6 was replaced by the compound of Synthesizing Example 7.

Preparation of Photoreceptors 3C through 10C

Photoreceptors 3C through 10C were prepared in the same manner as Photoreceptor 1C except that the compound of charge generation material, the compound of charge transfer material and the amount of them and the thickness of the charge transfer layer were changed as listed in Table 6. The interlayers B through J were prepared by employing organic particles and binder shown in Table 2.

Preparation of Photoreceptor 11C

Photoreceptor 11C was prepared in the same manner as Photoreceptor 1C except that the charge transfer material or the compound of Synthesizing Example 6 was replaced by the component n=0 of Compound 17C synthesized by the known method. The purity of the component was larger than 99%.

Preparation of Photoreceptor 12C

Photoreceptor 12C was prepared in the same manner as Photoreceptor 1C except that that the charge transfer material or the compound of Synthesizing Example 6 was replaced by the component n=5 of Chemical Structure 17C separated by liquid chromatography from the compound of Synthesizing Example 6. The purity of the component was larger than 99%. However, any photoreceptor capable of being subjected to the evaluation cannot be obtained since the compound was not permissible with the binder resin and precipitated.

Preparation of Photoreceptor 13C

The compound of Synthesizing Example 6 was separated by liquid chromatography into each component and a mixture of 50% of the component n=4 and 50% of that of n=5 of Chemical Structure was prepared. Then Photoreceptor 13C was prepared in the same manner as Photoreceptor 1C except that the charge transfer material was replaced by the above mixture.

Preparation of Photoreceptor 14C

Photoreceptor 14C was prepared in the same manner as Photoreceptor 1C except that inorganic particle was not employed in the inter layer.

TABLE 6

| | | CTL | | | | | | | | | | | | | | | | | | |
|---|---|---|---|---|---|---|---|---|---|---|---|---|---|---|---|---|---|---|---|---|
| | | CTM (Compound and component ratio) | | | | | | | | | | | | | | | | | | |
| (*1) No. | CGL CGM | Compound | n = 0 | n = 1 | n = 2 | n = 3 | n = 4 | n = 5 | n = 6 | n = 7 | n = 8 | n = 9 | n = 10 | n = 11 | (Rp + Rs) | (*2) | (*3) | (*4) | (*5) |
| 1C | Y | 17C | 14.8 | 25.1 | 27.4 | 18.1 | 9.9 | 3.4 | 1.1 | 0.2 | 0.0 | 0.0 | 0.0 | 0.0 | 52.5 | 910 | 150 | 19 | A |
| 2C | Y | 48C | 0.9 | 3.4 | 12.0 | 22.8 | 31.3 | 19.9 | 6.9 | 2.5 | 0.3 | 0.0 | 0.0 | 0.0 | 54.1 | 1684 | 150 | 19 | A |
| 3C | Y | 53C | 7.4 | 14.5 | 19.3 | 20.0 | 17.1 | 11.5 | 6.1 | 3.2 | 0.9 | 0.0 | 0.0 | 0.0 | 39.3 | 1680 | 150 | 19 | B |
| 4C | Y | 17C | 23.5 | 40.1 | 21.5 | 10.4 | 3.8 | 0.7 | 0.0 | 0.0 | 0.0 | 0.0 | 0.0 | 0.0 | 63.6 | 660 | 150 | 19 | C |
| 5C | Y | 17C | 32.1 | 47.0 | 15.4 | 4.4 | 1.1 | 0.0 | 0.0 | 0.0 | 0.0 | 0.0 | 0.0 | 0.0 | 79.1 | 523 | 225 | 24 | D |
| 6C | Y | 17C | 0.6 | 2.5 | 7.0 | 10.5 | 14.1 | 16.3 | 16.2 | 13.0 | 10.1 | 6.7 | 2.5 | 0.5 | 32.5 | 1520 | 150 | 13 | E |
| 7C | Z | 17C | 14.8 | 25.1 | 27.4 | 18.1 | 9.9 | 3.4 | 1.1 | 0.2 | 0.0 | 0.0 | 0.0 | 0.0 | 52.5 | 910 | 150 | 19 | F |
| 8C | Z | 48C | 0.9 | 3.4 | 12.0 | 22.8 | 31.3 | 19.9 | 6.9 | 2.5 | 0.3 | 0.0 | 0.0 | 0.0 | 54.1 | 1684 | 150 | 19 | G |
| 9C | Y | 38C | 6.9 | 13.8 | 20.2 | 21.1 | 17.1 | 11.0 | 5.9 | 2.7 | 1.3 | 0.0 | 0.0 | 0.0 | 41.3 | 1186 | 150 | 19 | H |
| 10C | Y | 17C | 62.9 | 28.1 | 6.2 | 1.8 | 0.0 | 0.0 | 0.0 | 0.0 | 0.0 | 0.0 | 0.0 | 0.0 | 91.0 | 471 | 150 | 19 | I |
| 11C | Y | 17C | 0.0 | 100 | 0.0 | 0.0 | 0.0 | 0.0 | 0.0 | 0.0 | 0.0 | 0.0 | 0.0 | 0.0 | 100 | 468 | 150 | 19 | A |
| 12C | Y | 17C | 0.0 | 0.0 | 0.0 | 0.0 | 0.0 | 100 | 0.0 | 0.0 | 0.0 | 0.0 | 0.0 | 0.0 | 100 | 1248 | 150 | 19 | A |
| 13C | Y | 17C | 0.0 | 0.0 | 0.0 | 0.0 | 50 | 50 | 0.0 | 0.0 | 0.0 | 0.0 | 0.0 | 0.0 | 100 | 1151 | 150 | 19 | A |
| 14C | Y | 17C | 14.8 | 25.1 | 27.4 | 18.1 | 9.9 | 3.4 | 1.1 | 0.2 | 0.0 | 0.0 | 0.0 | 0.0 | 52.5 | 910 | 150 | 19 | J |

(*1) Photo-receptor
(*2) Average Molecular weight (Mw)
(*3) Thickness (μm)
(*4) Thickness (μm)
(*5) Interlayer In the above table 6, Y and Z are the same as those in Table 1.

(Rp+Rs) is the same as that in Table 1.

The distribution or the ratio of the n of the chain structure of the charge transfer material was determined from the area ratio via high speed liquid chromatography GPC. The average Mw was the weight average molecular weight converted to polystyrene determined by gel permeation chromatography.

Evaluation

Thus obtained Photoreceptors 1C through 13C were each installed into a being a reversal development digital copying machine Konica 7085 having a scorotron charging device, a semi-conductor laser exposing device emitting light at 680 nm and a reversal developing unit, and operation of a copying rate of 85 sheets of A4 size paper per minute, and was evaluated in the same manner as in Example 1. Results of the evaluation are shown in Table 7.

TABLE 7

| Photoreceptor No. | Potential variation at solid black image area \|ΔV\| | Thinning of Character | Speckle | Recurring Defect | Cracking | Image density | Sharpness |
|---|---|---|---|---|---|---|---|
| 1C | A | A | A | A | A | A | A |
| 2C | A | A | A | A | A | A | A |
| 3C | A | A | A | A | A | A | A |
| 4C | A | A | A | A | A | A | A |
| 5C | A | A | A | A | A | A | A |
| 6C | B | B | A | A | A | B | B |
| 7C | A | A | A | A | A | A | A |
| 8C | B | B | A | B | A | A | B |
| 9C | B | B | A | A | A | B | B |
| 10C | A | B | A | A | A | B | B |
| 11C | C | C | B | B | B | C | C |
| 12C | Evaluation impossible | Evaluation impossible | Evaluation impossible | Evaluation impossible | Evaluation impossible | Evaluation impossible | Evaluation impossible |
| 13C | C | B | B | C | C | C | C |
| 14C | C | B | B | C | A | C | C |

As is shown in Table 6, Photoreceptors 1C through 10C using the mixture of compounds as the charge transfer material in each of which (Rp+Rs) is not more than 99% are excellent in the high speed response, namely the potential variation of the solid black image area is small, under low temperature and low humidity condition of 10° C. and 20% RH, accordingly thinning of the character image does not occur. In addition, the speckle, the recurring image defect and the cracking are not formed and results in excellent image density and sharpness. On the contrary, Photoreceptor 11C using only the low molecular weight compound n=1 is inferior in the high speed response under low temperature and humidity condition and causes thinning of image characters. In addition, the layer is soft; speckle and recurring image defects occur and image density and sharpness are also degraded. In the case of Photoreceptor 12C using only the high molecular weight compound n=5, the compatibility of the compound with a binder resin is poor, and the photoreceptor exhibits low sensitivity. Therefore, such a photoreceptor is not worth evaluation. In Photoreceptor 13C using the mixture of 50% of component n=4 and 50% of component n=5 of Chemical Structure 17C, the solubility of the compound mixture with the binder resin is insufficient. Consequently, the potential variation at the solid black image area is wide and recurring image defects and cracking occur. In addition the image density and the sharpness are also lowered. Photoreceptor 14C, which does not contain inorganic particle, showed high potential variation at black solid imaging portion, periodic image defects are found and showed low image density and sharpness.

The invention claimed is:

1. An electrophotographic photoreceptor comprising a support, and provided thereon, an interlayer comprising inorganic particle and a photosensitive layer, wherein the photosensitive layer contains a mixture of two or more compounds each of which is represented by Formula (1) having a specific number n different each other, $$X—(\text{CTM-group})_{n—Y} \quad (1)$$

wherein CTM-group is a charge transfer group; X and Y are each a hydrogen atom, a halogen atom or a mono-valent organic group; and n is an integer of 0 to 10, provided that n is not 0 when both X and Y are a hydrogen atom or a halogen atom, and (Rp+Rs) is not more than 99%, wherein Rp is a content of a compound represented by Formula (1) which has a first specific number n and a maximum content in the mixture, and Rs is a content of a component represented by Formula (1) which has a second specific number n and a content next to the maximum content based on weight in percent.

2. The electrophotographic photoreceptor of claim 1, wherein the photosensitive layer comprises a charge generation layer containing a charge transfer material and a charge transfer layer containing a charge transfer material, and the charge transfer material is the mixture of compounds.

3. The electrophotographic photoreceptor of claim 1, wherein (Rp+Rs) is from 30 to 99%.

4. The electrophotographic photoreceptor of claim 1, wherein a weight average molecular weight of the mixture is from 650 to 2,500.

5. The electrophotographic photoreceptor of claim 4, wherein the weight average molecular weight the mixture is from 800 to 2,000.

6. The electrophotographic photoreceptor of claim 1, wherein (Rp+Rs) is from 45 to 90%.

7. The electrophotographic photoreceptor of claim 1, wherein the CTM-group, X and Y in Formula (1) are each represented by following formulas (A), respectively, Formulas (A)

CTM-group:

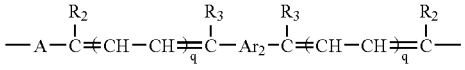

X:

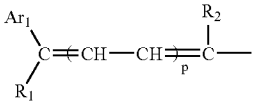

Y:

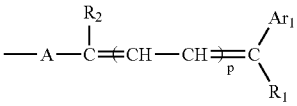

wherein $Ar_1$ is a substituted or unsubstituted mono-valent aromatic group; $Ar_2$ is a substituted or unsubstituted di-valent aromatic group, a substituted or unsubstituted di-valent furan or thiophene group, or a group represented by Formula (2); $R_1$ through $R_3$ are each a hydrogen atom, a substituted or unsubstituted alkyl group or a substituted or unsubstituted mono-valent aromatic group; A is a di-valent group having a triarylamino group or a group represented by Formula (3), plural $Ar_1$, $R_1$, $R_2$ and $R_3$ may be the same or different from each other, and p and q are each an integer of 0 or 1, Formula (2)

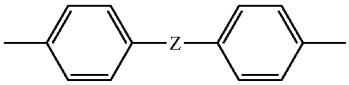

wherein Z is a single bond, an oxygen atom, a sulfur atom, a —CH═CH— group or a —C($R_4$)($R_5$)— group, and $R_4$ and $R_5$ may bond with together, Formula (3)

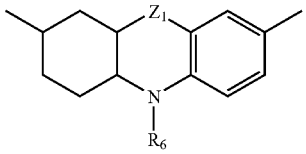

wherein $Z_1$ is a single bond, an alkylene group, an oxygen atom or a sulfur atom; and $R_6$ is a substituted or unsubstituted alkyl group, or substituted or unsubstituted aromatic group.

8. The electrophotographic photoreceptor of claim 7, wherein the divalent group having the triarylamino group is a group represented by the following Formula (4), Formula (4)

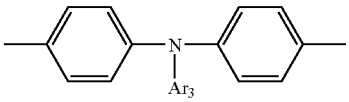

wherein $Ar_3$ is a substituted or unsubstituted mono-valent aromatic group.

9. The electrophotographic photoreceptor of claim 8, wherein the group represented by $Ar_3$ is a group represented by Formula (5), Formula (5)

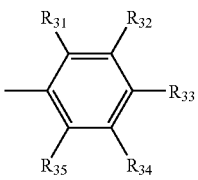

wherein $R_{31}$, $R_{32}$, $R_{33}$, $R_{34}$ and $R_{35}$ are each a hydrogen atom or an alkyl group having from 1 to 4 carbon atoms and at least one of $R_{31}$ and $R_{35}$ is an alkyl group having from 1 to 4 carbon atoms.

10. The electrophotographic photoreceptor of claim 7, wherein the di-valent group having a triarylamino group is a group represented by Formula (6), Formula (6)

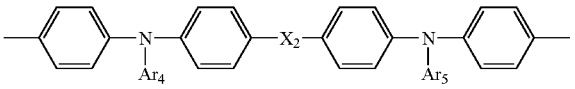

wherein $X_2$ is a single bond, a substituted or unsubstituted alkylene group, or a substituted or unsubstituted di-valent aromatic group; $Ar_4$ and $Ar_5$ are each a substituted or unsubstituted mono-valent aromatic group.

11. The electrophotographic photoreceptor of claim 1, wherein CTM-group, X and Y in Formula (1) are each represented by the following formulas (B), respectively, Formulas (B)

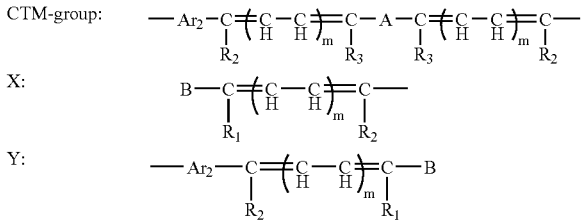

wherein, $Ar_2$ is a substituted or unsubstituted di-valent aromatic group, a substituted or unsubstituted di-valent furan or thiophene group or a group represented by Formula (2); $R_1$ through $R_3$ are each a hydrogen atom, a substituted or unsubstituted alkyl group, or a substituted or unsubstituted mono-valent aromatic group; A is a divalent group having a triarylamino group or a group represented by Formula: (3); and B is a substituted or unsubstituted mono-valent aromatic group; plural B, $R_1$, $R_2$ and $R_3$ each may be the same or different from each other, and m is an integer of 0 or 1.

12. The electrophotographic photoreceptor of claim 11, wherein the divalent group having the triarylamino group is a group represented by the following Formula (4), Formula (4)

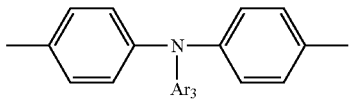

wherein $Ar_3$ is a substituted or unsubstituted mono-valent aromatic group.

13. The electrophotographic photoreceptor of claim 11, wherein the group represented by $Ar_3$ is a group represented by Formula (5), Formula (5)

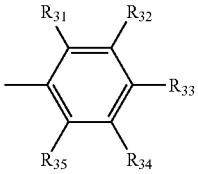

wherein $R_{31}$, $R_{32}$, $R_{33}$, $R_{34}$ and $R_{35}$ are each a hydrogen atom or an alkyl group having from 1 to 4 carbon atoms and at least one of $R_{31}$ and $R_{35}$ is an alkyl group having from 1 to 4 carbon atoms.

14. The electrophotographic photoreceptor of claim 11, wherein the di-valent group having a triarylamino group is a group represented by Formula (6), Formula (6)

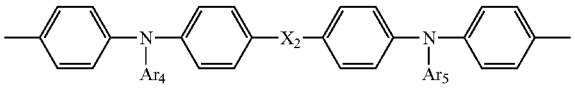

wherein $X_2$ is a single bond, a substituted or unsubstituted alkylene group, or a substituted or unsubstituted di-valent aromatic group; $Ar_4$ and $Ar_5$ are each a substituted or unsubstituted mono-valent aromatic group.

15. The electrophotographic photoreceptor of claim 11, wherein B is a group represented by Formula (7), Formula (7)

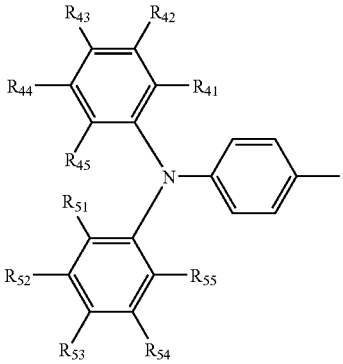

wherein $R_{41}$, $R_{42}$, $R_{43}$, $R_{44}$, $R_{45}$, $R_{51}$, $R_{52}$, $R_{53}$, $R_{54}$ and $R_{55}$ are each a hydrogen atom or an alkyl group having from 1 to 4 carbon atoms, provided that at least one of $R_{41}$, $R_{45}$, $R_{51}$ and $R_{55}$ is an alkyl group having from 1 to 4 carbon atoms.

16. The electrophotographic photoreceptor of claim 1, wherein the CTM-group in Formula (1), X, and Y are each represented by Formulas (C), Formulas (C)

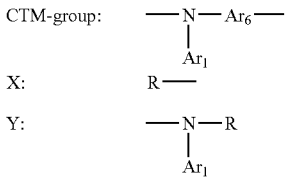

wherein $Ar_1$ is a substituted or unsubstituted mono-valent aromatic group; $Ar_6$ is a substituted or unsubstituted di-valent aromatic group, or a group represented by the following Formula (8); R is a substituted or unsubstituted alkyl group or a substituted or unsubstituted mono-valent aromatic group, and plural $Ar_1$, $Ar_6$ and R may be the same or different from each other, Formula (8)

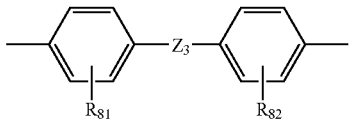

wherein $Z_3$ is an oxygen atom, a sulfur atom, a —CH═CH— group or a —$CH_2$—$CH_2$— group; and $R_{81}$, and $R_{82}$ are each a hydrogen atom or an alkyl group having from 1 to 4 carbon atoms.

17. A processing cartridge comprising the electrophotographic photoreceptor of claim 1, and at least one of a charging unit for uniformly charging the surface of the electrophotographic photoreceptor, a latent image forming unit for forming a latent image with a toner to form visible toner image on the charged electrophotographic photoreceptor, a developing unit for visualizing the latent image formed on the electrophotographic photoreceptor, a transferring unit for transferring the toner image visualized on the electrophotographic photoreceptor to a recording material, a discharging unit for removing the charge on the electrophotographic photoreceptor and a cleaning unit for removing the toner remaining on the electrophotographic photoreceptor, and is installed and released to from a main body of an image forming apparatus.

* * * * *